US005891197A

United States Patent [19]

Young et al.

[11] Patent Number: 5,891,197

[45] Date of Patent: Apr. 6, 1999

[54] STAIN RECEIVER FOR DRY CLEANING PROCESS

[75] Inventors: Terrill Alan Young; John Richard Noel, both of Cincinnati; Maxwell Gregory Davis, Forest Park, all of Ohio

[73] Assignee: The Proctor & Gamble Company, Cincinnati, Ohio

[21] Appl. No.: 897,622

[22] Filed: Jul. 21, 1997

Related U.S. Application Data

[60] Provisional application No. 60/022,971, Aug. 2, 1996.

[51] Int. Cl.[6] ..... D06B 1/10

[52] U.S. Cl. ..... 8/137; 8/142; 510/281; 510/282; 510/283; 510/284; 510/285; 510/291; 510/290; 510/293; 510/295; 510/297

[58] Field of Search ..... 501/281, 282, 501/283, 284, 285, 291, 290, 293, 295, 297; 604/378, 385.1, 358; 8/137, 142

[56] References Cited

U.S. PATENT DOCUMENTS

| | | | |
|---|---|---|---|
| 1,747,324 | 2/1930 | Savitt . | |
| 3,375,827 | 4/1968 | Bletzinger | 128/290 |
| 3,432,253 | 3/1969 | Dixon | 8/142 |
| 3,591,510 | 7/1971 | Zenk . | |
| 3,593,544 | 7/1971 | Henderson . | |
| 3,633,538 | 1/1972 | Hoeflin . | |
| 3,647,354 | 3/1972 | Loeb | 8/158 |
| 3,737,387 | 6/1973 | Marple . | |
| 3,764,544 | 10/1973 | Haworth . | |
| 3,882,038 | 5/1975 | Clayton . | |
| 3,907,496 | 9/1975 | Nél | 8/142 |
| 3,949,137 | 4/1976 | Akrongold . | |
| 3,956,556 | 5/1976 | McQueary . | |
| 4,007,300 | 2/1977 | McQueary | 427/242 |

(List continued on next page.)

FOREIGN PATENT DOCUMENTS

| | | |
|---|---|---|
| 1005204 | 2/1977 | Canada . |
| 0 208 989 | 1/1987 | European Pat. Off. . |
| 0 213 500 | 3/1987 | European Pat. Off. . |
| 0 261 718 | 3/1988 | European Pat. Off. . |
| 0 429 172 A1 | 5/1991 | European Pat. Off. . |
| 537760 | 11/1931 | Germany . |
| 2021561 | 11/1970 | Germany . |
| 2460239 | 7/1975 | Germany . |
| 4007362 | 9/1991 | Germany . |
| 1397475 | 6/1975 | United Kingdom . |
| 1598911 | 9/1981 | United Kingdom . |
| 2302553 | 1/1997 | United Kingdom . |
| 2302878 | 2/1997 | United Kingdom . |
| 2302879 | 2/1997 | United Kingdom . |
| WO 91/09104 | 6/1991 | WIPO . |
| WO 91/13145 | 9/1991 | WIPO . |
| WO 93/25654 | 12/1993 | WIPO . |
| WO 96/39556 | 12/1996 | WIPO . |
| WO 97/00990A2 | 1/1997 | WIPO . |
| WO 97/00993A1 | 1/1997 | WIPO . |
| WO 97/20094 | 6/1997 | WIPO . |

OTHER PUBLICATIONS

Derwent Abstract No. 94–250036/31 for DE 4303454, Aug. 1994.

*Primary Examiner*—Alan Diamond
*Attorney, Agent, or Firm*—Steven R. Chuey; Kim W. Zerby; Jacobus C. Rasser

[57] ABSTRACT

The present invention encompasses a stain receiver article and its use in a fabric cleaning process. The invention also encompasses a kit, comprising: (a) an aqueous fabric cleaning/refreshment composition which is, optionally, releasably contained on a carrier substrate; a re-usable, preferably vapor-venting, containment bag; a stain receiver article according to this invention; optionally, but preferably, a fabric cleaning device, as disclosed herein; optionally, a re-usable holding tray; and optionally, a non-aqueous cleaning composition. The invention also encompasses the stain receiver article, itself.

12 Claims, 9 Drawing Sheets

U.S. PATENT DOCUMENTS

| | | | |
|---|---|---|---|
| 4,013,575 | 3/1977 | Castrantas et al. . | |
| 4,097,397 | 6/1978 | Mizutani . | |
| 4,102,824 | 7/1978 | Mizutani . | |
| 4,115,061 | 9/1978 | Grünewälder | 8/137 |
| 4,126,563 | 11/1978 | Barker . | |
| 4,130,392 | 12/1978 | Diehl | 8/101 |
| 4,139,475 | 2/1979 | Schwadtke et al. . | |
| 4,336,024 | 6/1982 | Denissenko et al. | 8/142 |
| 4,395,261 | 7/1983 | Lutz | 8/111 |
| 4,532,722 | 8/1985 | Sax . | |
| 4,578,070 | 3/1986 | Holtman | 604/378 |
| 4,594,362 | 6/1986 | Smith et al. | 521/52 |
| 4,606,842 | 8/1986 | Keyes . | |
| 4,610,678 | 9/1986 | Weisman | 604/368 |
| 4,640,810 | 2/1987 | Laursen et al. | 264/518 |
| 4,659,496 | 4/1987 | Klemm . | |
| 4,692,277 | 9/1987 | Siklosi . | |
| 4,758,641 | 7/1988 | Hsu | 526/208 |
| 4,790,840 | 12/1988 | Cortina | 604/385.1 |
| 4,797,310 | 1/1989 | Barby . | |
| 4,798,603 | 1/1989 | Meyer et al. | 604/378 |
| 4,802,997 | 2/1989 | Fox . | |
| 4,806,254 | 2/1989 | Church . | |
| 4,849,257 | 7/1989 | Borcher . | |
| 4,886,615 | 12/1989 | Dehan . | |
| 4,909,962 | 3/1990 | Clark . | |
| 4,943,392 | 7/1990 | Hastedt . | |
| 4,966,724 | 10/1990 | Culshaw . | |
| 4,983,317 | 1/1991 | Requejo . | |
| 5,004,557 | 4/1991 | Nagarajan . | |
| 5,041,230 | 8/1991 | Borhcer . | |
| 5,062,973 | 11/1991 | Kellett . | |
| 5,080,822 | 1/1992 | VenEenam . | |
| 5,102,573 | 4/1992 | Han . | |
| 5,112,358 | 5/1992 | Deal | 8/137 |
| 5,173,200 | 12/1992 | Kellett . | |
| 5,213,624 | 5/1993 | Williams | 134/40 |
| 5,238,587 | 8/1993 | Smith . | |
| 5,264,268 | 11/1993 | Luceri . | |
| 5,364,382 | 11/1994 | Latimer et al. | 604/378 |
| 5,525,407 | 6/1996 | Yang . | |
| 5,547,476 | 8/1996 | Siklosi et al. | 8/142 |
| 5,569,226 | 10/1996 | Cohen et al. | 604/378 |
| 5,591,236 | 1/1997 | Roetker | 8/137 |
| 5,630,847 | 5/1997 | Roetker | 8/137 |
| 5,630,848 | 5/1997 | Young et al. | 8/137 |
| 5,632,780 | 5/1997 | Siklosi | 8/137 |
| 5,746,776 | 5/1998 | Smith et al. | 8/142 |

STAIN RECEIVER FOR DRY CLEANING PROCESS

CROSS REFERENCE

This application claims the benefit of, under Title 35 Unites States Code 119(e), Provisional Application Serial No. 60/022,971, filed Aug. 2, 1996.

1. Field of the Invention

The present invention relates to an absorbent article which is designed for use in a fabric cleaning process.

2. Background of the Invention

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments. In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape.

One type of home dry cleaning system comprises a carrier sheet containing various cleaning agents, and a plastic bag. The garments to be cleaned are sealed in the bag together with the sheet, and then tumbled in a conventional clothes dryer. In a commercial embodiment, multiple single-use flat sheets and a single multi-use plastic bag are provided in a package. Unfortunately, such processes may not satisfactorily remove localized heavy spots and stains from fabrics. Accordingly, it is preferred to use a spot removal or "pre-spotting" step in the overall process.

Conventional fabric pre-spotting consists mainly of applying a cleaning composition to the localized area of the spot or stain, followed by vigorous side-to-side rubbing with a towel, brush or other implement. This type of aggressive treatment can fray individual fibers in the fabric being treated, thereby resulting in undue "wear" and deterioration in the fabric's appearance.

It has been discovered that fabrics can be gently, yet effectively, pre-spotted by means of a device which allows the application of Z-directional forces to the fabrics without the side-to-side (X- and Y-direction) rubbing techniques used heretofore. This cleaning, especially spot stain removal, is accomplished using a minimum amount of cleaning ingredients such as water, solvents, surfactants, and minors, using a receiver to accept the stain and cleaning fluid and using a flexible moisture proof container with heat and mechanical agitation provided by a household or possibly commercial (Laundromat) dryer.

The nonwoven receiver structure afforded by this invention provides a particularly effective means of drawing stain-containing solvent through and away from a garment which is being hand-cleaned using small quantities of water-based cleaning/refreshment compositions as disclosed hereinafter. Thus, stain removal is rendered more efficient and unsightly residues from pre-spotting compositions on the fabric are minimized. This is of particular importance where the fabrics are to be subjected to a subsequent non-immersion cleaning/refreshment process as described herein, since persistent residues and stains would be unacceptable to the user.

BACKGROUND ART

The manufacture of certain types of "TBAL" structures is disclosed in U.S. Pat. No. 4,640,810, issued Feb. 3, 1987 to H. Laursen, et al. Use of such structures in diapers and feminine hygiene products is disclosed, for example, in U.S. Pat. No. 5,264,268 issued Nov. 23, 1993 to Luceri, et al.; U.S. Pat. No. 5,364,382 issued Nov. 15, 1994 to Latimer, et al.; U.S. Pat. No. 5,525,407 issued to Yang on Jun. 11, 1996; U.S. Pat. No. 5,569,226 issued Nov. 29, 1996 to Cohen, et al.; U.S. Pat. No. 4,578,070 issued Mar. 25, 1996 to Holtman; U.S. Pat. No. 3,375,827 issued Apr. 2, 1968 to Bletzinger; and U.S. Pat. No. 4,798,603 issued Jan. 17, 1989 to Meyer, et al. Dry cleaning processes are disclosed in: U.S. Pat. No. 5,547,476 issued Aug. 20, 1996 to Siklosi & Roetker; U.S. Pat. No. 5,591,236 issued Jan. 7, 1997 to Roetker; U.S. Pat. No. 5,630,847 issued May 20, 1997 to Roetker; U.S. Pat. No. 5,630,848 issued May 20, 1997 to Young, et al.; U.S. Pat. No. 5,632,780 issued May 27, 1997 to Siklosi; EP 429,172A1, published May 29, 1991, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. Nos. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EP 0 261 718; G.B. 1,397,475; WO 91/09104; WO 91/13145; WO 93/25654 and Hunt, D. G. and N. H. Morris, "PnB and DPnB Glycol Ethers", HAPPI, April 1989, pp.78–82.

SUMMARY OF THE INVENTION

The present invention encompasses a stain receiver article and its use in a fabric cleaning process. In one typical aspect, the invention provides a process for spot cleaning stained fabrics, comprising:

(a) placing the localized stained area of the fabric over and in contact with an Absorbent Stain Receiver Article ("ASRA") as disclosed herein;

(b) applying enough cleaning/refreshment composition to the fabric to saturate the localized stained area;

(c) optionally, allowing the composition to penetrate the stain for 3–5 minutes;

(d) removing the fabric from contact with the Absorbent Stain Receiver Article.

Preferred Compositions

In a preferred mode the liquid cleaning composition comprises water and a surfactant, preferably a surfactant which comprises a mixture of MgAES surfactant and amine oxide surfactant. The composition also preferably comprises water and a solvent, preferably butoxy propoxy propanol. As an overall consideration, the compositions typically comprise the solvent and at least about 95%, by weight, of water, preferably also comprising a solvent and a surfactant, i.e., water, a solvent and a surfactant.

In a preferred mode the process is conducted by working the composition into the stain by means of mechanical force applied to the stain. In a highly preferred mode, the ASRA is a fibrous TBAL structure. As disclosed hereinafter, the synthetic fiber content of the low capillary pressure zone of the ASRA is preferably higher than the synthetic fiber content of the high capillary pressure zone, and is about 80% to about 100%, preferably about 100%, by weight, of synthetic fiber.

The invention also encompasses a kit comprising an Absorbent Stain Receiving Article and a portion of a liquid cleaning composition.

In more detail, the process herein can be conducted using the following steps:

1. Place the stained area of the fabric over and in contact with the Absorbent Stain Receiver Article of this invention;
2. Apply enough cleaning/refreshment composition to saturate the localized stained area—typically about 10 drops; more may be used for a larger stain. Preferably, this is done using a bottle with a narrow spout which directs the composition onto the stain so as not to unnecessarily saturate the surrounding area of the fabric.
3. Optionally, allow the composition penetrate the stain for 3–5 minutes. (This is a pre-treat or pre-hydration step for better cleaning results.)
4. Optionally, apply additional composition—about 10 drops; more may be used for larger stains.
5. Use mechanical force, e.g., by means of the spot removal device as disclosed herein to work stain completely out. Rock the device (i.e. force applied in the downward "Z" direction) firmly against the stain for 20–120 seconds, longer for tougher stains. Do not rub (i.e., force applied in the side-to-side "X-Y" direction) the stain with the device, since this can harm the fabric.
6. Remove the fabric from contact with the Absorbent Stain Receiver Article.
7. Optionally, blot the fabric between paper towels or other absorbent materials to remove excess cleaning composition.
8. Optionally, complete the cleaning/refreshment of the entire fabric by conducting the in-dryer cleaning/refreshment process disclosed herein, preferably using a vapor-venting containment bag as disclosed hereinafter.

In an alternate mode, the cleaning/refreshment composition can be applied to the stain (Step 2 and/or 4) by spraying, daubing or by padding the composition on from a carrier sheet, or by any other convenient means.

An overall cleaning/refreshment process for treating an entire area of fabric surface, which comprises a prespotting operation according to this invention, thus comprises the overall steps of:

(i) conducting a stain removal process on localized stained areas of fabric in conjunction with the Absorbent Stain Receiver Article;

(ii) placing the entire fabric from step (i) together with a carrier containing the aqueous fabric cleaning/refreshment composition in a containment bag, preferably of the vapor-venting type;

(iii) placing the bag in a device to provide agitation, e.g., such as in a hot air clothes dryer, and operating the dryer with heat and tumbling to moisten the fabric and, preferably, to provide vapor venting; and (iv) removing the fabric from the bag.

Preferably, the fabric is immediately hung to avoid wrinkle formation.

The invention also encompasses a kit, comprising:

(a) an aqueous fabric cleaning/refreshment composition which is releasably contained on a carrier substrate;

(b) a re-usable, preferably vapor-venting, containment bag;

(c) one or more Absorbent Stain Receiver Articles according to this invention;

(d) optionally, but preferably, a fabric cleaning device, as disclosed herein;

(e) optionally, a re-usable holding tray; and (f) optionally, a non-aqueous cleaning composition.

(g) optionally, but preferably, a separate portion of an aqueous cleaning ("pre-spotting") composition for use in the pre-spotting step herein.

All percentages, ratios and proportions herein are by weight, unless otherwise specified. All documents cited are, in relevant part, incorporated herein by reference.

DETAILED DESCRIPTION OF THE INVENTION

Figure 1:
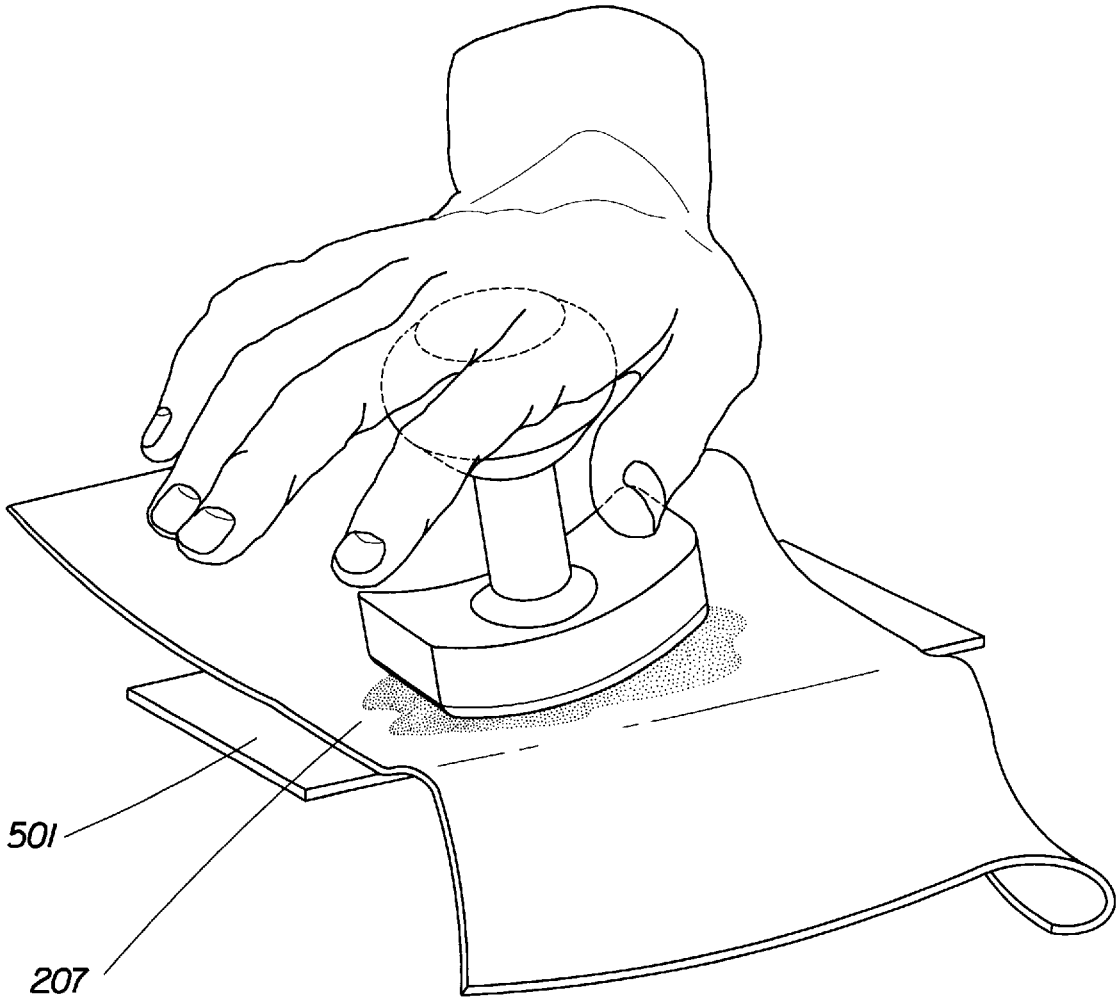
FIG. 1 illustrates the use of the device by using hand pressure to rock the device, thereby causing the protuberances which extend outwardly from the arcuate, convex head to impinge on the stained (207) fabric and to impart a cleaning force perpendicular to the stain. Undesirable side-to-side (shear) forces on the fabric are thus minimized or eliminated. The Absorbent Stain Receiver Article (501) according to this invention is shown underlaying the stained area of fabric.

Absorbent Stain Receiver Article ("ASRA")—The ASRA herein can comprise any of a number of absorbent structures which provide a capillary pressure difference through their thickness (Z-direction). When designing the ASRA for use in the spot removal process herein, the following matters are taken into consideration. First, the cleaning solution only removes the soil from the fibers of the fabric even with agitation. If the cleaning solution which carries the soil is allowed to remain in the fabric, the soil will be redeposited on the fabric as the cleaning solution dries. The more complete the removal of cleaning solution from the fabric, the more complete will be the removal of soil.

Second, the fabric being treated is, itself, basically a fibrous absorbent structure which holds liquid (i.e., the cleaning solution) in capillaries between the fibers. While some liquid may be absorbed into the fibers, most of the liquid will be held in interfiber capillaries (this includes capillaries between filaments twisted into a thread). Liquid held in the fabric may be removed by contacting it with another absorbent structure such as the ASRA, herein. In this process, liquid is transferred from the capillaries of the fabric to the capillaries of the ASRA.

Third, liquid is held in capillaries by capillary pressure. Capillary pressure (Pc) is generally described by the following equation:

$$Pc=(2\times G\times \text{Cos } A)/R$$

where

G=the surface tension of the liquid

A=the contact angle between the liquid and the capillary wall

R=the radius of the capillary

Accordingly, capillary pressure is highest in capillaries which have a low contact angle and a small radius. Liquid is held most tightly by high capillary pressure and will move from areas of low capillary pressure to areas of high capillary pressure. Hence, in the subject ASRA which provides a capillary pressure difference through its thickness, liquid will move from low capillary pressure areas to high capillary pressure areas. Capillary pressure can be measured using a variety of techniques, but will employ the liquid cleaning composition as the test liquid.

In reality, most absorbent materials are complex structures comprised of a range of a range of capillary sizes and contact angles. For this discussion, the capillary pressure of a material or capillary pressure zone within a material is defined as the volumetric weighted average of the range of pressures found within that material or zone.

For purposes of illustration, in circumstances wherein a soiled fabric saturated with cleaning solution is in liquid communication contact with two stacked, identical layers of homogeneous absorbent material, such as a paper towel, solution and soil would readily transfer from the fabric to the towel until the capillary pressure is approximately equal in the two materials. At equilibrium a certain amount of solution and soil will remain in the fabric. The exact amount will depend on the basis weight and capillary pressure characteristics of the fabric and towel. A reduced amount of residual solution and soil in the fabric, and therefore better cleaning, would result from replacing the bottom layer (layer not in direct contact with the fabric) of towel with an absorbent layer of capillary pressure higher than that of the towel. By virtue of its higher capillary pressure this absorbent layer will cause more solution to transfer from the low capillary pressure top towel layer to the high capillary pressure absorbent layer which in turn causes more solution to transfer from the fabric to the top towel layer. The result is better cleaning due to less residual solution and soil remaining in the fabric.

This type of multi-layer system is also beneficial when Z-directional pressure is applied to the wetted stained fabric and ASRA. This pressure compresses the various materials, thereby lowering their void volume and liquid absorption capacity (increasing the % saturation of the materials). This can cause liquid to be squeezed out. The layered structure allows for free liquid to be absorbed by the lower layer, i.e., the one furthest away from the fabric. This lessens the reabsorption of liquid by the fabric. This is especially true if the bottom layer (layer of highest capillary pressure) is also relatively incompressible (retains a higher percentage of its void volume under pressure) compared to the top layer (layer of lower capillary pressure). In this case it may be desirable for the top layer to be resiliently compressible so as to express liquid under pressure which can be absorbed by the bottom layer.

Thus the ASRA can comprise two or more relatively distinct layers which differ in capillary pressure. As can be seen from the capillary pressure equation, a difference in capillary pressure can be achieved by varying the capillary size or the contact angle between the cleaning solution and the ASRA. Both factors can be controlled by the composition of the ASRA. The contact angle portion of the equation can also be affected by chemical treatment of the ASRA with, for example, a surfactant to lower the contact angle or a water repellent material such as silicone to increase contact angle.

The effectiveness of an ASRA comprising multiple layers of differing capillary pressure can be enhanced by locating most of the total absorbent capacity in the high capillary pressure portion. The top fabric facing layer need only be thick enough to insulate the fabric from the liquid held in the bottom layer.

The effectiveness of the layered ASRA can be further enhanced by selecting the low capillary pressure portion to have a capillary pressure higher than that of the fabric being treated.

In an ASRA comprised of two or more layers differing in capillary pressure, the pattern of capillary pressure change can be characterized as "stepped". Through the thickness of the ASRA there is a sharp change or step in capillary pressure at the layer interfaces. It will be appreciated that the ASRA herein need not comprise multiple distinct layers, but rather can comprise a single layer structure with a relatively continuous capillary size gradient through its thickness.

Fibers—The ASRA can be made from a variety of materials including fibrous absorbents and foams. Useful fibrous absorbents include nonwoven fabrics (carded, hydroentangled, thermal bonded, latex bonded, meltblown, spun, etc.), thermal bonded airlaid nonwovens ("TBAL"), latex bonded airlaid nonwovens ("LBAL"), multi-bonded airlaid nonwovens ("MBAL" combined latex and thermal bonded), wet laid paper, woven fabrics, knitted fabrics or combination of materials (i.e., top layer of a carded nonwoven, and a bottom layer of wet laid paper). These fibrous absorbents can be manufactured using a wide variety of fibers including both natural and synthetic fibers. Useful fibers include wood pulp, rayon, cotton, cotton linters, polyester, polyethylene, polypropylene, acrylic, nylon, multi-component binder fibers, etc. Multiple fiber types can be blended together to make useful materials. Useful foam materials include polyurethane foams and high internal phase emulsion foams. The critical factor is to have a difference in capillary pressure within the thickness of the ASRA. A broad range of fiber sizes can be employed. A typical, but non-limiting range of diameters is from about 0.5 micrometers to about 60 micrometers. For meltblown, the preferred fibers are less than about 10 micrometers. Typical spun-bond and synthetic staple fibers range in diameter from about 14 to about 60 micrometers. In general, one selects smaller diameter fibers for the high capillary pressure layer and higher diameters for low capillary pressure. Fiber length can depend on the forming process that is being used and the desired capillary pressure. Spun-bonds comprise a substantially continuous fiber. For air-laid fibers, 4–6 mm is typical. For carded fibers the range is typically 25–100 mm. In addition, it has now been found that enriching the upper layer in bicomponent fibers decreases linting during use. Cleaning can also be enhanced by making the top layer rich in synthetic (e.g., bicomponent) fibers due to their lipophilic nature which aids in the removal of oily stains from the fabric being treated.

Absorbent gelling materials ("AGM") such as those sometimes referred to in the diaper art as 'supersorbers' can be added to either or both layers of the receiver or as a discrete layer between the fiber layers or on the back of the bottom layer of the ASRA. Functionally, the AGM provides additional liquid absorption capacity and serves to drain the capillaries in the ASRA structure which helps to maintain the capillary pressure gradient as liquid is absorbed.

In light of the foregoing considerations, the ASRA herein can be defined as an absorbent structure which has a capillary pressure difference through its thickness (Z-direction). In a typical, but non-limiting mode, this can be achieved by having relatively larger capillaries (for example 50–100 micrometers radius) in the upper, liquid-receiving portion of the ASRA which is placed in contact with the fabric being treated. The lower, liquid-storage portion having relatively smaller capillaries (for example 5–30 micrometers radius). Irrespective of the size employed, it is desirable that the difference in average capillary pressure between the two layers be large enough that the overlap in capillary pressure range between the two layers is minimized.

Basis Weight—The basis weight of the ASRA can vary depending on the amount of cleaning solution which must be absorbed. A preferred 127 mm×127 mm receiver absorbs about 10–50 grams of water. Since very little liquid is used in the typical stain removal process, much less capacity is actually required. A typical TBAL ASRA pad weighs about 4–6 grams. A useful range is therefore about 1 gram to about 7 grams. A variety of sizes can be used, e.g., 90 mm×140 mm.

Size—The preferred size of the ASRA is about 127 mm×127 mm, but other sizes can be used, e.g., 90 mm×140 mm. The shape can also be varied.

Thickness—The overall thickness of the preferred ASRA is about 3 mm (120 mils) but can be varied widely. The low end may be limited by the desire to provide absorbency impression. A reasonable range is 25 mils to 200 mils.

Lint Control Binder Spray—The ASRA is preferably dust free. Some materials are naturally dust free (synthetic non-woven fabrics). Some, generally cellulose containing materials, can be dusty because not all the fibers are bonded. Dust can be reduced by bonding substantially all the fibers which reside on or near the surface of the ASRA which contacts the fabric being treated. This can be accomplished by applying resins such as latex, starch, polyvinyl alcohol or the like. Cold or hot crimping, sonic bonding, heat bonding and/or stitching may also be used along all edges of the receiver to further reduce Tinting tendency.

Backing Sheet—The ASRA is generally sufficiently robust that it can be used as-is. However, in order to prevent strike-through of the liquid onto the table top or other treatment surface selected by the user, it is preferred to affix a liquid-impermeable barrier sheet to the bottom-most surface of the lower layer. This backing sheet also improves the integrity of the overall article. The bottom-most layer can be extrusion coated with an 0.5–2.0 mil, preferably 1.0 mil, layer of polyethylene or polypropylene film using conventional procedures. A film layer could also be adhesively or thermally laminated to the bottom layer. The film layer is designed to be a pinhole-free barrier to prevent any undesired leakage of the cleaning composition beyond the receiver. This backing sheet can be printed with usage instruction, embossed and/or decorated, according to the desires of the formulator. The ASRA is intended for use outside the dryer. However, since the receiver may inadvertently be placed in the dryer and subjected to high temperatures, it is preferred that the backing sheet be made of a heat resistant film such as polypropylene or nylon.

Colors—White is the preferred color for the ASRA as it allows the user to observe transfer of the stain from the fabric to the receiver. However, there is no functional limit to the choice of color. The backing sheet can optionally be a contrasting color.

Embossing—The ASRA can also be embossed with any desired pattern or logo.

Manufacture—A typical, but non-limiting, embodiment of the ASRA herein is a TBAL material which consists of an upper, low capillary pressure layer which is placed in liquid communication contact with the fabric being treated and a bottom high capillary pressure layer. The ASRA can be conveniently manufactured using procedures known in the art for manufacturing TBAL materials; see U.S. Pat. No. 4,640,810. As an overall proposition, TBAL manufacturing processes typically comprise laying-down a web of absorbent fibers, such as relatively short (2–4 mm) wood pulp fibers, in which are commingled relatively long (4–6 mm) bi-component fibers. The sheath of the bicomponent fiber melts with the application of heat to achieve thermal bonding. The bi-component fibers intermingled throughout the wood pulp fibers thereby act to 'glue' the entire mat together. Both layers in one embodiment of the ASRA herein can be a homogeneous blend of wood pulp fibers and bi-component thermal bonding fibers. In a more preferred embodiment, the top layer is 100% concentric bi-component fiber comprising 50:50 (wt.) polyethylene (PE) and polypropylene (PP) comprising a PP core enrobed in an outer sheath of PE. The gradient is achieved by providing a higher proportion of bicomponent bonding fibers in the top layer compared to the bottom layer. Using a TBAL process as described in U.S. Pat. No. 4,640,810, the top, low capillary pressure layer is formed by a first forming station from 100% bicomponent fiber (AL-Thermal-C, 1.7 dtex, 6 mm long available from Danaklon a/s). Basis weight of this all-bicomponent top layer is approximately 30 gsm (grams/meter$^2$). The bottom, high capillary pressure layer is formed upon the top layer by second and third forming stations from a fiber blend consisting of approximately 72% wood pulp (Flint River Fluff available from Weyerhaeuser Co.) and approximately 28% bi-component binder fiber. Basis weight of this bottom layer is approximately 270 gsm. Each of the second and third forming station deposits approximately half of the total weight of the bottom layer. The two layers are then calendered to provide a final combined thickness of approximately 3 mm. Subsequently, a 1.0 mil coating of polypropylene is extrusion coated onto the exposed surface of the bottom layer. Individual receivers are cut to 127 mm×127 mm size. In one optional mode, since the material will be wound into a roll before applying the back sheet, a binder (e.g., latex—Airflex 124 available from Air Products) can be applied to the exposed surface of the lower layer prior to thermal bonding to prevent transfer of dust to the top all-bicomponent layer. Alternatively, a non-linting sheet can be placed on the ASRA during roll-up to prevent linting due to contact between the surfaces.

The composition and basis weights of the layers can be varied while still providing an ASRA with the desired capillary pressure gradient and cleaning performance. Non-limiting examples are as follows.

| Bottom High Capillarity Layer Composition Ratio Pulp/Bicomponent Fiber (wt./wt.); Basis Weight ca. 270 gsm | Top Low Capillarity Layer 100% Bicomponent; Basis Weight (gsm) |
|---|---|
| 72/28 | 20 |
| 72/28 | 10 |
| 79/21 | 30 |
| 79/21 | 20 |
| 79/21 | 10 |
| 86/14 | 10 |
| 86/14 | 20 |
| 86/14 | 30 |

Another TBAL structure useful herein comprises a top (fluid receiving) layer comprising about 50% bicomponent fiber and 50% wood pulp, with a basis weight of about 50 gsm. The bottom layer is an 80/20 (wt.) blend of wood pulp and bicomponent staple fiber with a basis weight of about 150 gsm.

It will be appreciated by those skilled in the art of absorbent materials that the foregoing ASRA's will provide layers or zones of relatively higher and lower capillarity. The terms "high" and "low"/"higher" and "lower" are to be understood as being relative to the capillarities of the layers or zones in ASRA's herein and not to some external standard. Accordingly, as long as the capillarity of the upper, fluid receiving layer or zone is lower than that of the underlying layer or zone, the ASRA's will function in their intended manner. However, for comparison purposes and not by way of limitation, the capillarity of the "low" capillarity layer will typically be in the range from about 2 cm of water to about 15 cm of water, and the capillarity of the "high" capillarity layer will typically be in the range from about 10 cm of water to about 50 cm of water. (Capillarity can be measured using the cleaning composition of interest according to the procedure reported at Column 11, U.S. Pat. No. 4,610,678, Weisman, et al., issued Sep. 6, 1986, with reference to the basic procedure and apparatus design as reported by Burgeni and Kapur, "Capillary Sorption Equilibria in Fiber Masses", *Textile Research Journal,* 37 (1967) 362, which publications are incorporated herein by reference.)

Usage Conditions—The ASRA herein is intended to be made so inexpensively that it can be discarded after a single use. However, the structures are sufficiently robust that multiple re-uses are possible. In any event, the user should preferably position the article such that "clean" areas are positioned under the stained areas of the fabric being treated in order to avoid release of old stains from the ASRA back onto the fabric.

Containment Bag—It has now been discovered that high water content compositions can be loaded onto a carrier substrate such as a cloth or woven or non-woven towelette and placed in a bag environment in a heated operating clothes dryer, or the like, to remove malodors from fabrics as a dry cleaning alternative or "fabric refreshment" process. The warm, humid environment created inside this bag volatilizes malodor components in the manner of a "steam distillation" process, and moistens fabrics and the soils thereon. This moistening of fabrics can loosen pre-set wrinkles, but it has now been discovered that overly wet fabrics can experience setting of new wrinkles during the drying stage toward the end of the dryer cycle. Proper selection of the amount of water used in the process and, importantly, proper venting of the bag in the present manner can minimize wrinkling. Moreover, if the bag is not vented, the volatilized malodorous materials removed from the fabrics can undesirably be re-deposited thereon.

The design of the venting ability of the bag is critical to achieving a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors.

The bag must be designed with sufficient venting to trap a portion of water vapors (especially early in the dryer cycle) but to allow most of the water to escape by the end of the cycle. Said another way, the rate of vapor release is, preferably, optimized to secure a balance of vapor venting and vapor trapping. A preferred bag design employs a water vapor impermeable film such as nylon, with a the closure flap (preferably with a hook-and-loop VELCRO®-type fastener) like that of a large envelope. The degree of slack in the fold-over portion of the closure flap can be varied to provide a vapor-venting air gap or partial opening which controls the rate of vapor venting from of the bag. In another mode, a notch is cut along the edge of the side wall opposite the flap to further adjust the venting. The fastener devices shown in the Figures run only partly along the line of closure, thereby allowing venting to occur at the lateral edges of the closure.

Figure 10:
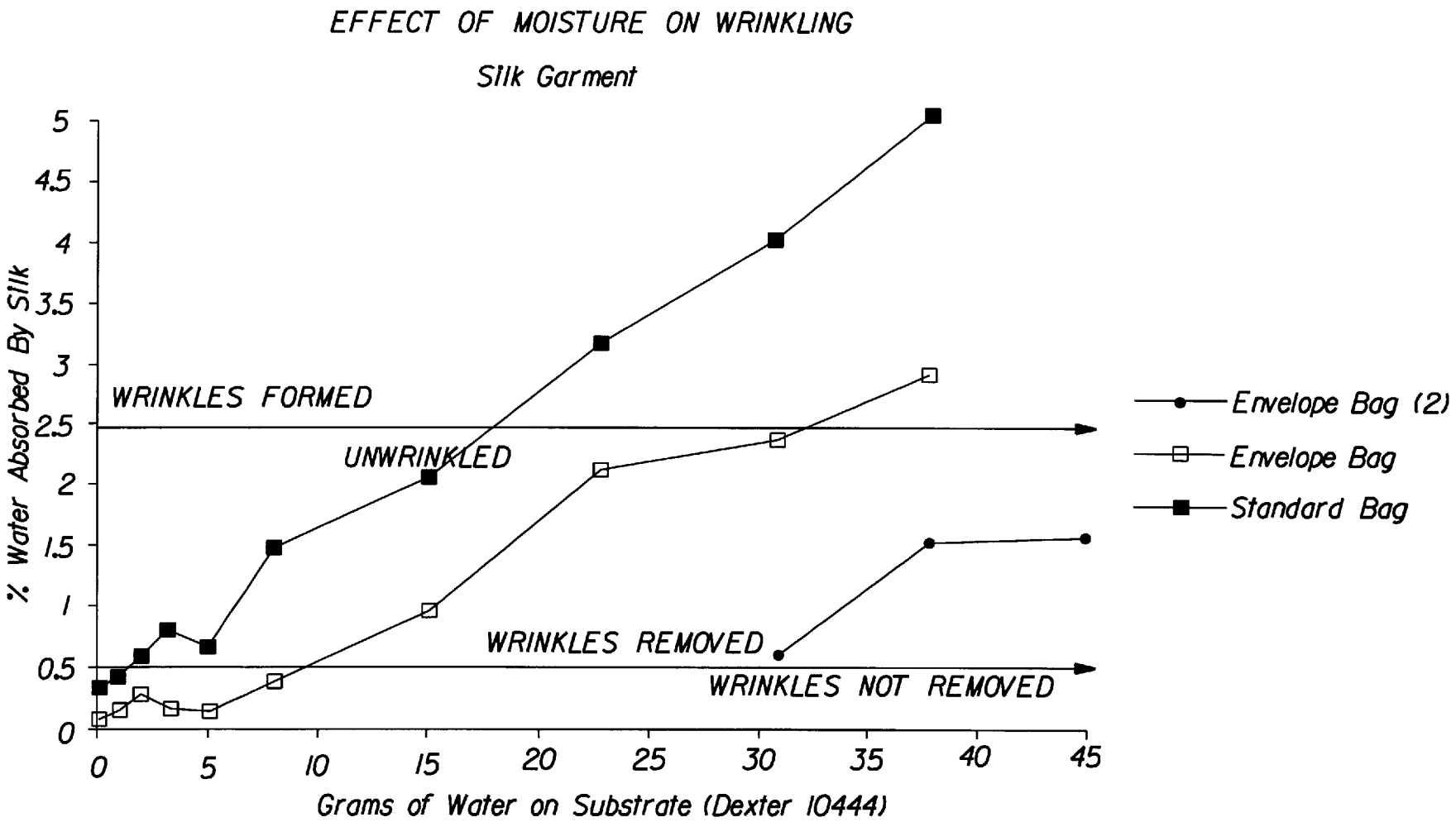
FIG. 10 is a graph which shows the relationship between operating regions of the in-dryer step of the overall process with respect to fabrics wherein Wrinkles Form, Unwrinkled, Wrinkles Removed and Wrinkles not Removed.

As can be seen from FIG. 10, the objective herein is to operate within the region of Unwrinkled/Wrinkles Removed on the graph. This region can vary with fabric type. However, as an overall proposition, conducting the process in the manner disclosed herein results in minimizing the formation of new wrinkles and removing wrinkles which are already present in the garments prior to treatment. Moreover, with respect to malodor, it is preferred to deliver sufficient water (grams of water on substrate) to achieve substantial malodor removal. In practice, this means that the operation with the vented bag herein is conducted under conditions towards the right-hand portion of the curve, i.e., in the range between about 15.2 to about 31 grams of liquid cleaning/refreshment composition. Referring to the graph, less liquid can be used, but wrinkles will not be efficiently removed from the fabrics and malodor removal will suffer. Too much liquid, e.g., about 38 grams on this graph, for a bag with 60% venting (60 VVE) as described hereinafter will cause wrinkles to begin to form in the fabrics. A bag of higher VVE can operate in the ideal range at higher moisture levels (e.g., "Envelope Bag 2"). With regard to these considerations, it has been observed that the carrier substrate used should not be so saturated with the liquid compositions herein that it is "dripping" wet. If excessively wet ("dripping"), localized water transfer to the fabrics being cleaned and refreshed can cause wrinkling. While it might have been thought that a larger carrier substrate could be used to provide more liquid capacity, this can be self-limiting. Carrier sheets which are too large can become entangled with the fabrics being cleaned/refreshed, again resulting in excessive localized wetting of the fabrics. Accordingly, while the carrier sheets used herein are optimal for bag and dryer sizes as noted, their sizes can, without undue experimentation, be adjusted proportionately for larger and smaller bag and/or dryer drum capacities.

The fabrics, when removed from the bag, will usually contain a certain amount of moisture. This will vary by fabric type. For example, silk treated in the optimal range shown on the graph may contain from about 0.5% to about 2.5%, by weight, of moisture. Wool may contain from up to about 4%, by weight, of moisture. Rayon also may contain up to about 4% moisture. This is not to say that the fabrics are, necessarily, frankly "damp" to the touch. Rather, the fabrics may feel cool, or cool-damp due to evaporative water losses. The fabrics thus secured may be hung to further air dry, thereby preventing wrinkles from being re-established. If desired, the fabrics can be ironed or subjected to other finishing processes, according to the desires of the user.

The following is intended to assist the formulator in the manufacture and use of vapor-venting bags in the manner of this invention, but is not intended to be limiting thereof.

Bag Dimensions

Figure 5:
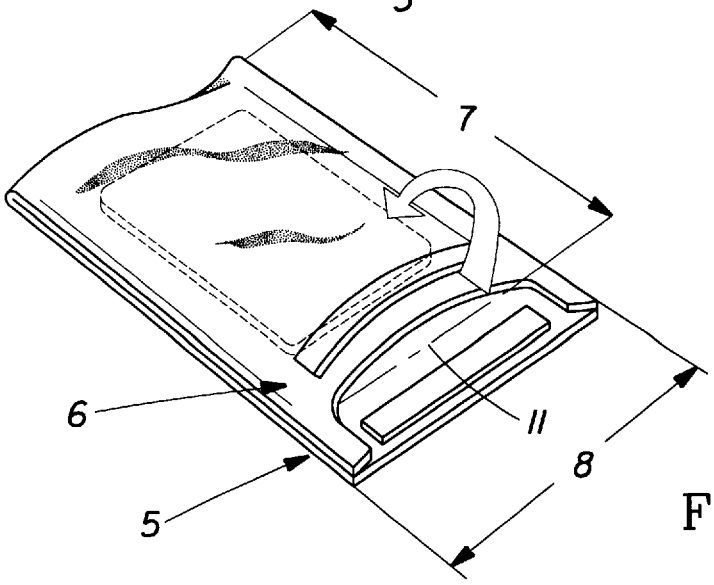
FIG. 5 is a perspective of the sheet within the bag which is ready to receive the fabrics to be treated in a hot air clothes dryer.

FIG. 5 shows the overall dimensions of the bag: i.e., length (7) to fold line 27⅝ inches; width (8) of bag 26 inches, with a flap to the base of the fold line of 2⅜ inches. In the Tests reported hereinafter, this bag is referred to by its open dimensions as "26 in.×30 in.".

Figure 6:
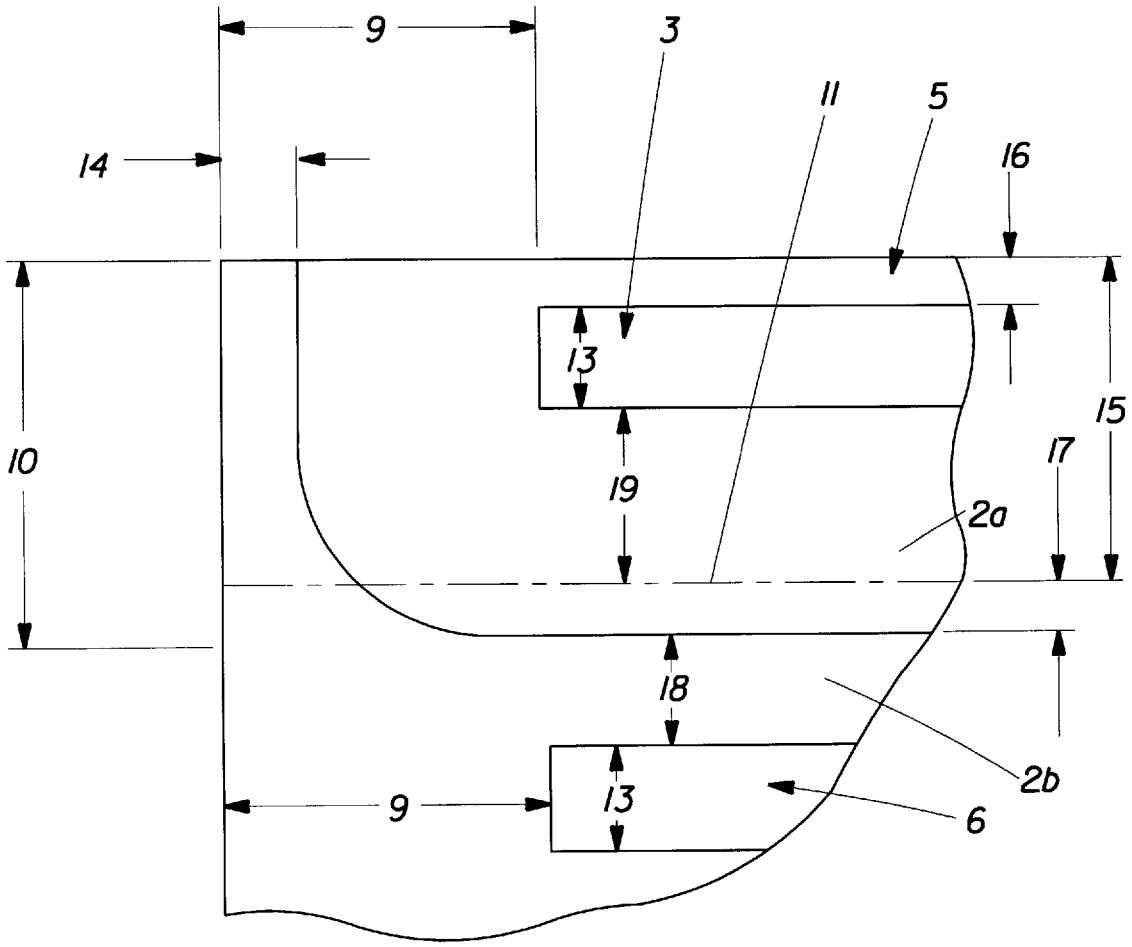
FIG. 6 is a partial view of the notched wall of the bag and its disposition relative to the closure flap.

FIG. 6 gives additional details of the positioning of the various elements of the notched bag. In this embodiment, all dimensions are the same for both the left hand and right hand sides of the bag. The dimensions herein are for an opened bag which is about 30 inches in overall length (including the flap) and about 26 inches wide. The distance (9) from the lateral edge of the bag to the outermost edge of the fastening device (3) located on the inside of the flap (5) is about 2 inches. In this embodiment, the fastening device (3) comprises the loop portion of a VELCRO®-type strip whose width (13) is about 0.75 inches and whose total length is about 22 inches. Fastening device (6) is similarly situated on the outside of wall 2(*b*) and comprises the hook portion of a ¾ inch VELCRO®-type strip. Distance (9) can be decreased or increased to decrease or increase venting at the edges of the flap when the bag is closed and the fastener is engaged. The distance (10) between the uppermost edge of the flap and the base of the notch is about 2⅞ inches. The distance (14) between the lateral edge of the bag and the lateral edge of the notch is about 0.25 inches. The distance (15) between the uppermost edge of the flap and the fold (11) is about 2⅜ inches. The distance (16) between the uppermost edge of the flap and the leading edge of the VELCRO®-type strip (3) affixed to the flap is about ⅜ inches. The distance (17) between fold (11) and the lowermost edge of the notch is about ½ inch. This distance also can be varied to decrease or increase vapor venting. A range of 0.25–1.5 inches is typical. The distance (18) between the uppermost edge of the VELCRO®-type strip (6) and the bottom edge of the notch is about ¾ inches. The distance (19) between the bottommost edge of the VELCRO®-type strip (3) and the fold (11) is about 1¼ ¼ inches.

Figure 7:
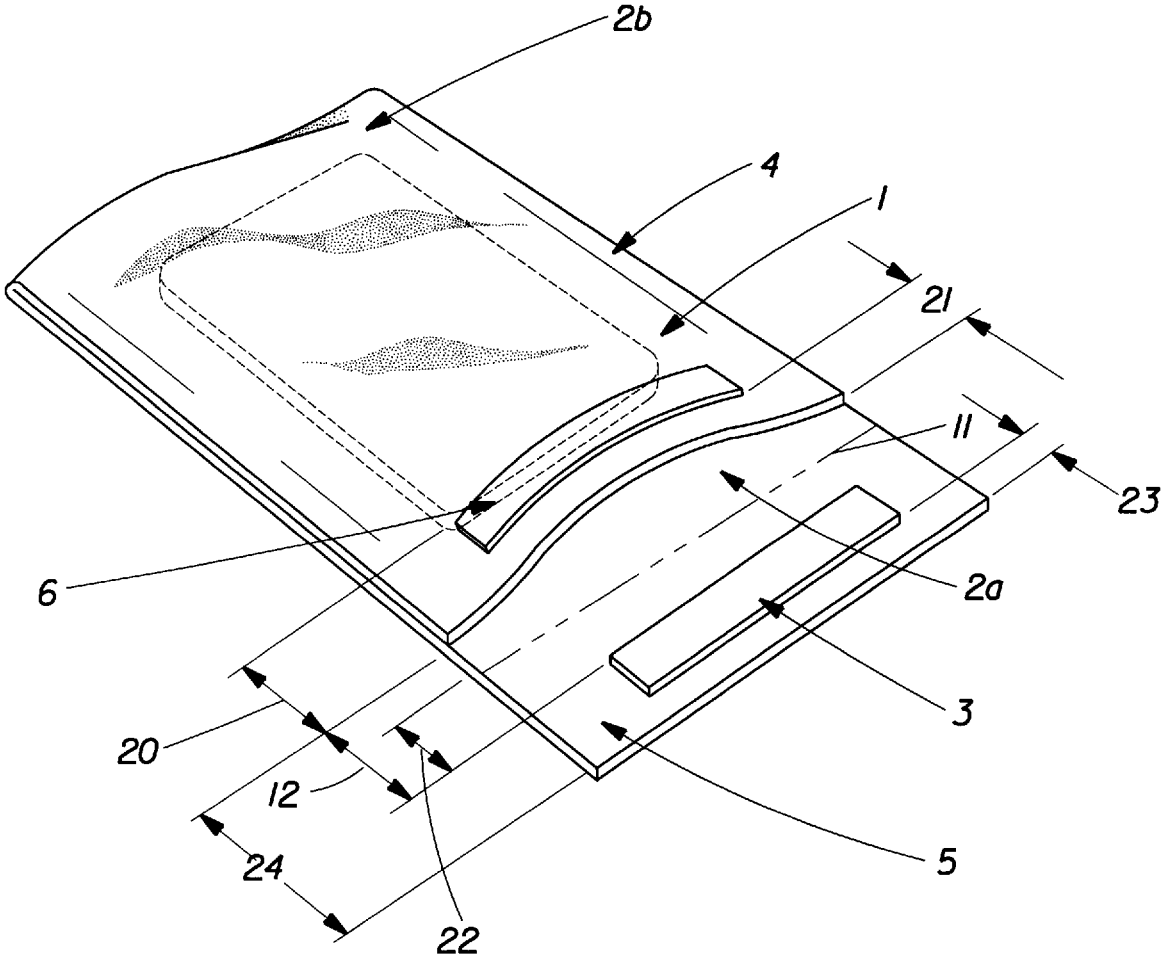
FIG. 7 is a perspective of an un-notched vapor-venting bag containing a loose cleaning/refreshment sheet.

FIG. 7 gives additional details of the dimensions of an un-notched envelope bag of the foregoing overall size. Again, each VELCRO®-type strip (3) and (6) is about ¾ inches in width and about 22 inches in length. Each strip is positioned so as to be inboard from each of the lateral edges of the finished bag wall and flap by about 2 inches. The distance (12) between the leading edge of the sidewall (2*b*) to the base edge of the fastener strip (3) on the flap portion of the bag is about 2½ inches. The distance (20) between the base edge of the fastener strip (6) to the leading edge of the sidewall (2*b*) is about 2.25 inches. The distance (21) between the leading edge of the fastener strip (6) to the leading edge of the sidewall is about 1⅜ inches. The distance (22) between fold (11) and the base edge of the fastener strip (3) is about 2 inches. The distance (23) between the leading edge of fastener strip (3) and the uppermost edge of the flap is about 0.25 inches. Distance (24) is about 3⅝ inches. As in the foregoing notched bag, the positioning and length of the fasteners can be adjusted to decrease or increase venting.

Vapor Venting Evaluation—In its broadest sense, the containment bag of this invention is designed to be able to vent at least about 40%, preferably at least about 60%, up to about 90%, by weight, of the total moisture introduced into the bag within the operating cycle of the clothes dryer or other hot air apparatus used in the process herein. (Of course most, if not all, of the organic cleaning solvents will also be vented during together with the water. However, since water comprises the major portion of the cleaning/refreshment compositions herein, it is more convenient to measure and report the venting as water vapor venting.)

It will be appreciated by those knowledgeable about the operation of hot air clothes dryers and similar apparatus that the rate of venting will usually not be constant over the entire operating cycle. All dryers have a warm-up period at the beginning of the operating cycle, and this can vary according to the specifications of the manufacturer. Most dryers have a cool-down period at the end of the operating cycle. Some venting from the containment bag herein can occur during these warm-up and cool-down periods, but its rate is generally less than the venting rate over the main period of the drying cycle. Moreover, even during the main period of the cycle, many modern dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved.

Moreover, the user of the present containment bag may choose to stop the operation of the drying apparatus before the cycle has been completed. Some users may wish to secure fabrics which are still slightly damp so that they can be readily ironed, hung up to dry, or subjected to other finishing operations.

Apart from the time period employed, the Vapor-Venting Equilibrium ("VVE") for any given type of vapor-venting closure will depend mainly on the temperature achieved within the dryer—which, as noted above, is typically reported as an average "dryer air temperature". In point of fact, the temperature reached within the containment bag is more significant in this respect, but can be difficult to measure with accuracy. Since the heat transmittal through the walls of the bag is rather efficient due to the thinness of the walls and the tumbling action afforded by conventional clothes dryers, it is a reasonable approximation to measure the VVE with reference to the average dryer air temperature.

Moreover, it will be appreciated that the vapor-venting from the containment bag should not be so rapid that the aqueous cleaning/refreshment composition does not have the opportunity to moisten the fabrics being treated and to mobilize and remove the soils/malodors therefrom. However, this is not of practical concern herein, inasmuch as the delivery of the composition from its carrier substrate onto the fabrics afforded by the tumbling action of the apparatus occurs at such a rate that premature loss of the composition by premature vaporization and venting is not a factor. Indeed, the preferred bag herein is designed to prevent such premature venting, thereby allowing the liquid and vapors of the cleaning/refreshment composition to remain within the bag for a period which is sufficiently long to perform its intended functions on the fabrics being treated.

The following Vapor-Venting Evaluation Test (VVET) illustrates the foregoing points in more detail. Larger or smaller containment bags can be used, depending on the volume of the dryer drum, the size of the fabric load, and the like. As noted above, however, in each instance the containment bag is designed to achieve a degree of venting, or VVE "score", of at least about 40% (40 VVE), preferably at least about 60% (60 VVE), up to about 90% (90 VVE).

VAPOR-VENTING EVALUATION TEST

Materials

Envelope or "Standard", i.e., Control Containment Bag to be evaluated for VVE. Carrier Substrate (15"×11") HYDRASPUN® carrier substrate sheet from Dexter with (10444) or without (10244) Binder Wool Blouse: RN77390, Style 12288, Weight approx. 224 grams Silk Blouse: RN40787, Style 0161, Weight approx. 81 grams Rayon Swatch: 45"×17", Weight approx. 60 grams Pouch (5"×6.375") to contain the Carrier Substrate and water De-ionized Water, Weight is variable to establish VVE.

Pretreatment of Fabrics

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure

1. Water of various measured weights from 0 to about 40 grams is applied to the carrier substrate a minimum of 30 minutes before running a vented bag test. The substrate is folded, placed in a pouch and sealed.
2. Each fabric is weighed separately and the dry weights are recorded. Weights are also recorded for the dry carrier substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the carrier substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the carrier substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

It can be seen from examining a series of VVET results at various initial moisture levels that the water at lower initial levels is being disproportionately captured by the garment load, the headspace, and the nylon bag, such that venting of water and volatile malodors begins in earnest only after the VVE value is achieved. Since this occurs only when about 15–20 grams or more of water is initially charged, it is seen that a VVE of greater than about 40 is needed to avoid excessive wetting of garments, leading to unacceptable wet-setting of wrinkles, as discussed herein.

Malodor and Wrinkle Removal

The processes herein which are conducted in the vapor-venting containment bag provide a marked improvement in the overall appearance and refreshment of fabrics, both with respect to the near absence of malodors and wrinkles, as compared with untreated fabrics.

One assessment of the processes herein with respect to malodors comprises exposing the fabrics to be tested to an atmosphere which contains substantial amounts of cigarette smoke. In an alternate mode, or in conjunction with the smoke, the fabrics can be exposed to the chemical components of synthetic perspiration, such as the composition available from IFF, Inc. Expert olfactory panelists are then used to judge odor on any convenient scale. For example, a scale of 0 (no detectable odor) to 10 (heavy malodor) can be established and used for grading purposes. The establishment of such tests is a matter of routine, and various other protocols can be devised according to the desires of the formulator.

For example, garments to be "smoked" are hung on clothing hangers in a fume hood where air flow has been turned off and vents blocked. Six cigarettes are lighted and set in ashtrays below the garments. The hood is closed and left until the cigarettes have about half burned. The garments are then turned 180° to get even distribution of smoke on all surfaces. Smoking is then continued until all cigarettes are consumed. The garments are then enclosed in sealed plastic bags and allowed to sit overnight.

After the aging of about one day, the garments are treated in the cleaning/refreshment process of the current invention. The garments are removed promptly from the containment bag when the dryer cycle is finished, and are graded for malodor intensity. The grading is done by an expert panel, usually two, of trained odor and perfume graders. The malodor intensity is given a grade of 0 to 10, where 10 is full initial intensity and 0 is no malodor detected. A grade of 1 is a trace detection of malodor, and this grade is regarded as acceptably low malodor to most users.

In the absence of perfume ingredients in the cleaning cloth composition, the grading of residual malodor intensity is direct indication of degree of cleaning or removal of malodorous chemicals. When perfumed compositions are used, the grading panelists can also generate a score for perfume intensity and character (again on a 0 to 10 scale), and the malodor intensity grading in this case would indicate the ability of the residual perfume to cover any remaining malodorous chemicals, as well as their reduction or removal.

After the garment odor grading taken promptly after the cleaning/refreshment process, the garments are hung in an open room for one hour and graded again. This one-hour reading allows for an end-effect evaluation that would follow cool-down by the garments and drying of the moisture gained in the dryer cycle treatment. The initial out-of-bag grading does reflect damp-cloth odors and a higher intensity of warm volatiles from the bag, and these are not factors in the one-hour grades. Further garment grading can be done at 24 hours and, optionally, at selected later times, as test needs dictate.

Likewise, fabric wrinkles can be visually assessed by skilled graders. For example, silk fabric, which wrinkles rather easily, can be used to visually assess the degree of wrinkle-removal achieved by the present processes using the vapor-venting bag. Other single or multiple fabrics can optionally be used. A laboratory test is as follows.

DE-WRINKLING TEST

MATERIALS

As above for VVET.

De-ionized Water, Weight range (0–38 grams)

Pretreatment of Fabrics

The silk fabric is placed in a hamper, basket, or drum to simulate normal conditions that are observed after wearing. These storage conditions produce garments that are severely wrinkled (well defined creases) and require a moist environment to relax the wrinkles.

TEST PROCEDURE

1. One silk fabric is placed in a containment bag being tested.
2. Water(0–38 grams) is applied to the carrier substrate a minimum of 30 minutes before running the test, placed in a pouch and sealed.
3. The silk garment is placed in the test containment bag along with the water-containing substrate (removed from its pouch and unfolded).
4. The bag is closed and placed in a Whirlpool Dryer (Model LEC7646DQO) for 30 minutes at high heat (48–74 C. cycle).
5. At the end of 30 minutes, the dryer bag is removed from the dryer IMMEDIATELY and the silk garment is placed on a hanger.
6. The silk garment is then visually graded versus the Control Garment from the same Pretreatment Of Fabrics.

In laboratory tests of the foregoing type, the in-dryer, non-immersion cleaning/refreshment processes herein typically provide malodor (cigarette smoke and/or perspiration) malodor grades in the 0–1 range for smoke and somewhat higher for perspiration malodors, thereby indicating good removal of malodor components other than those of sufficiently high molecular weights that they do not readily "steam vaporize" from the fabrics. Likewise, fabrics (silks) have wrinkles removed to a sufficient extent that they are judged to be reasonably suitable for wearing with little, or no, ironing.

Figure 4:
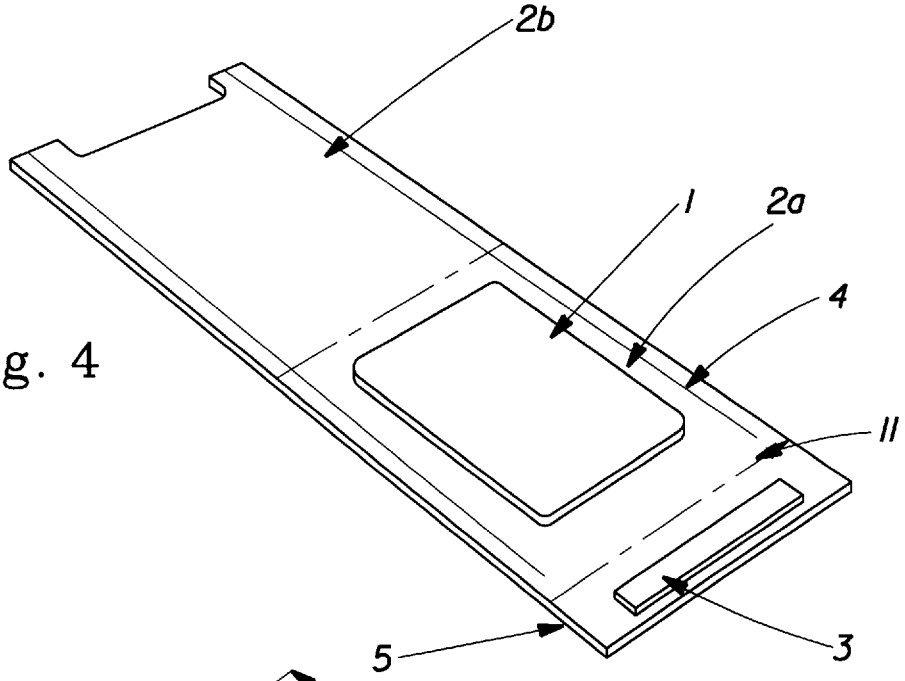
FIG. 4 is a perspective of the cleaning/refreshment sheet loosely resting on a notched, vapor-venting containment bag which is in a pre-folded condition.

The construction of the preferred, heat-resistant vapor-venting bag used herein to contain the fabrics in a hot air laundry dryer or similar device preferably employs thermal resistant films to provide the needed temperature resistance to internal self-sealing and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the fastener is also constructed of a thermal resistant material. As shown in FIGS. 4 and 5, in one embodiment, 1 to 3 mil heat-resistant Nylon-6 film is folded and sealed into a containment bag. Sealing can be done using standard impulse heating equipment. In an alternate mode, a sheet of nylon is simply folded in half and sealed along two of its edges. In yet another mode, bags can be made by air blowing operations. The method of assembling the bags can be varied, depending on the equipment available to the manufacturer and is not critical to the practice of the invention.

The dimensions of the containment bag can vary, depending on the intended end-use. For example, a relatively smaller bag can be provided which is sufficient to contain one or two silk blouses. Alternatively, a larger bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 0.2–5 kg) without being so large as to block dryer vents in most U.S.-style home dryers. Somewhat smaller bags may be used in relatively smaller European and Japanese dryers.

The bag herein is preferably flexible, yet is preferably durable enough to withstand multiple uses. The bag also preferably has sufficient stiffness that it can billow, in-use, thereby allowing its contents to tumble freely within the bag during use. Typically, such bags are prepared from 0.025 mm to 0.075 mm (1–3 mil) thickness polymer sheets. If more rigidity in the bag is desired, somewhat thicker sheets can be used.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C.). Under circumstances where excessive heating is not of concern, the bag can be made of polyester, polypropylene or any convenient polymer material.

Perfume—As noted above, the higher molecular weight, high boiling point, malodorous chemicals tend to be retained on the fabrics, at least to some degree.

These malodors can be overcome, or "masked" by perfumes. However, it will be appreciated from the foregoing that the perfumer should select at least some perfume chemicals which are sufficiently high boiling that they are not entirely vented from the bag along with volatile malodors. A wide variety of aldehydes, ketones, esters, acetals, and the like, perfumery chemicals which have boiling points above about 50° C., preferably above about 85° C., are known. Such ingredients can be delivered by means of the carrier substrate herein to permeate the contents of the containment bag during the processes herein, thereby further reducing the user's perception of malodors. Non-limiting examples of perfume materials with relatively high boiling components include various essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol and mixed pine oil terpenes, linalool, linalyl acetate, geraniol, nerol, 2-(1,1-dimethylethyl)-cyclohexanol acetate, orange terpenes and eugenol. Of course, lower boiling materials can be included, with the understanding that some loss will occur due to venting.

OVERALL PRE-SPOTTING/CLEANING PROCESS

The components of the cleaning/refreshment compositions, processes and devices used in this invention and their method of use with the Absorbent Stain Receiver Article herein are described in more detail hereinafter. Such disclosure is by way of illustration and not limitation of the invention herein. The definitional terms used herein have the following meanings.

By "phase-stable" herein is meant liquid compositions which are homogeneous over their intended usage range (ca. 50° F.–95° F.) (10° C.–35° C.), or which, if stored temperatures which cause phase separation (~40° F.–110° F.) (4.4° C.–43° C.), will revert to their homogeneous state when brought back to temperatures in the intended usage range.

By an "effective amount" herein is meant an amount of the alkyl sulfate and/or alkyl ethoxy sulfate or other surfactant sufficient to provide a phase-stable liquid composition, as defined hereinabove.

By "aqueous" cleaning compositions herein is meant compositions which comprise a major portion of water, plus the optional BPP or other cleaning solvents, the aforesaid surfactant or surfactant mixture, optional other surfactants, especially amine oxides, hydrotropes, perfumes, and the like, especially those disclosed hereinafter.

By "cleaning" herein is meant the removal of soils and stains from fabrics. By "refreshment" herein is meant the removal of malodors and/or wrinkles from the fabrics, or the improvement of their overall appearance, other than primarily removing soils and stains. Typical fabric refreshment compositions can comprise more water (95–99.9%, preferably greater than 95% up to about 99%) and fewer cleaning ingredients than typical cleaning compositions.

By "protuberances" herein is meant knobs, fibers, bristles or like structures which extend outwardly from the surface of the treatment device. Such elements of the device come into contact with the fabric being spot-cleaned ("pre-spotted") to provide the mechanical cleaning action.

By "contact with stained areas" with respect to the cleaning device is meant contact which is afforded by impingement of the protuberances, pads, sponges, etc., which comprise the treatment means or device with the one side of the stained area. It is highly desirable that this contact result in a force which is directed substantially downward, i.e., in the Z-direction substantially perpendicular to the surface of the stain, rather than a side-to-side scrubbing motion in the X- and Y-directions, to minimize fabric damage or "wear". Preferably, the contact is associated with a rocking or rolling motion by the device, whereby the curved surface of the device imparts the force in the Z-direction. By "contact with the stained areas" with respect to the stain receiver is meant that the side of the stained area of the fabric opposite the cleaning device directly impinges on the stain receiver and is in close communication therewith.

Figure 3:
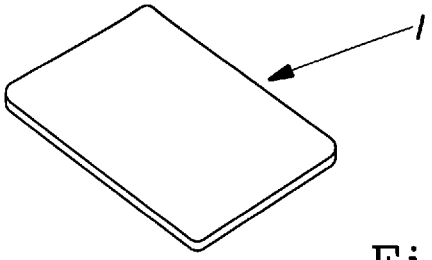
FIG. 3 is a perspective of a cleaning/refreshment sheet (1) of the type used herein.

As shown in the drawings, FIG. 3 illustrates an integral carrier substrate (1) which is releasably impregnated with the cleaning/refreshment composition. FIG. 4 illustrates one form of a pre-formed, notched, vapor-venting containment bag in an open configuration with the loose carrier substrate, first side wall (2*a*), second side wall (2*b*), first fastening device (3), side seal (4) and flexible flap (5). In another mode, the bag can be fashioned by blowing techniques, wrap-around techniques, or other convenient methods. The method of manufacturing the bag is not critical to the practice of the invention. In use, flexible flap (5) is folded along fold line (11) to provide the vapor-venting closure for the bag.

FIG. 5 shows the "envelope-style" bag in a finished configuration and containing the loose carrier substrate sheet (1). In-use, the fabrics to be cleaned/refreshed are placed in the bag with the substrate sheet and flap (5) is folded along fold line (11) to engage first fastening device (3) with the opposing second fastening device (6) to fasten the flap, thereby providing a vapor-venting closure which is sufficiently stable to withstand tumbling in a hot air clothes dryer or similar device.

FIG. 6 shows a cut-away view of the corner of the containment bag illustrating the interior of the first side wall (2*a*) and second side wall (2*b*), first fastening device (3), second fastening device (6), flap (5), and fold line (11). The distance between the edge of the bag (9) and the depth of the notch (11) in second side wall (2*b*) are dimensions which are set forth hereinabove.

Figure 8:
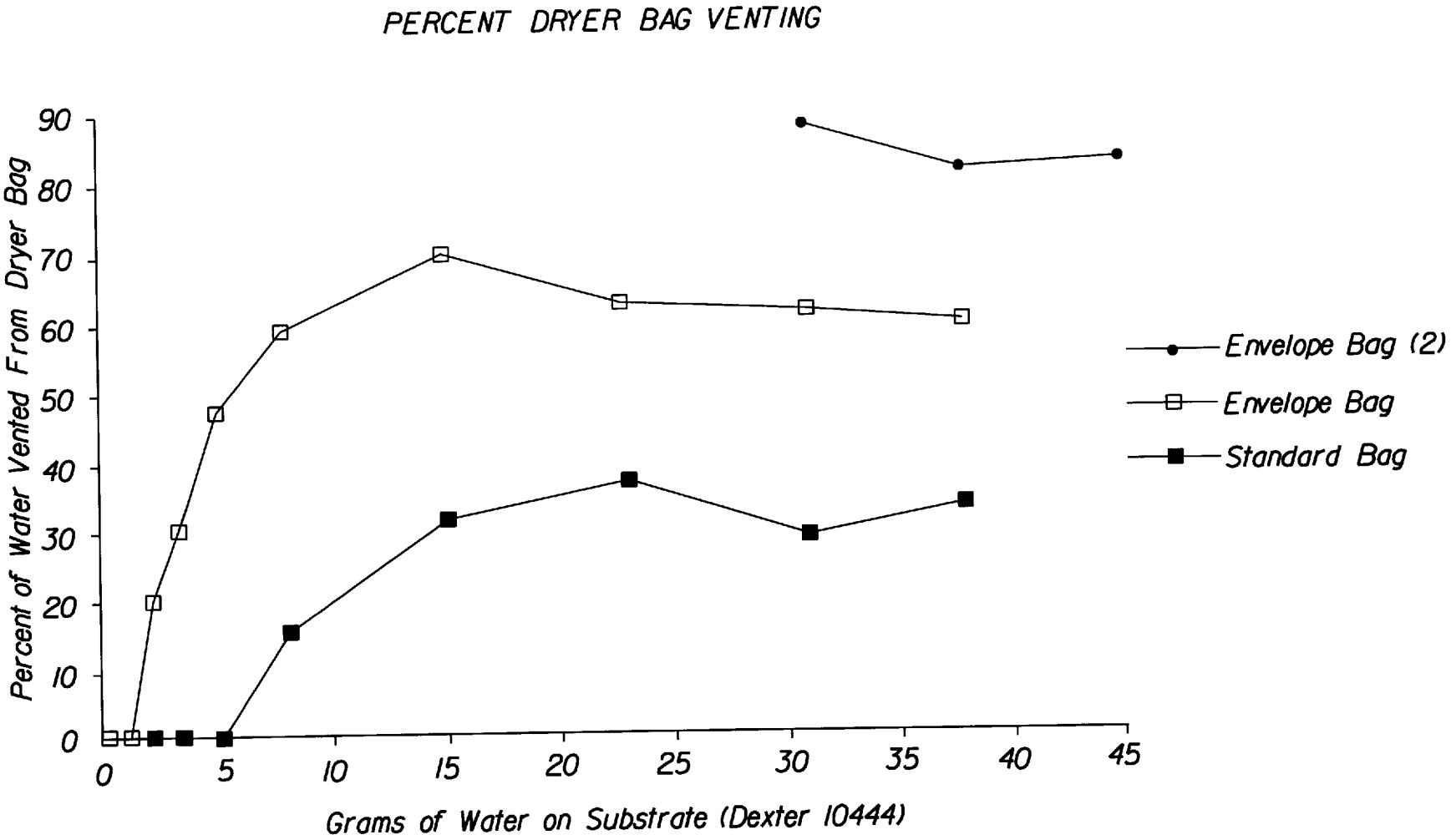
FIG. 8 is a graph of water venting from a vapor-venting "Envelope"-style Bag with the vapor-venting closure, from a Standard Bag, i.e., a sealed bag without the venting closure (as control for comparison purposes); and from an "Envelope Bag (2)" which has a vapor venting closure at each end.
Figure 9:
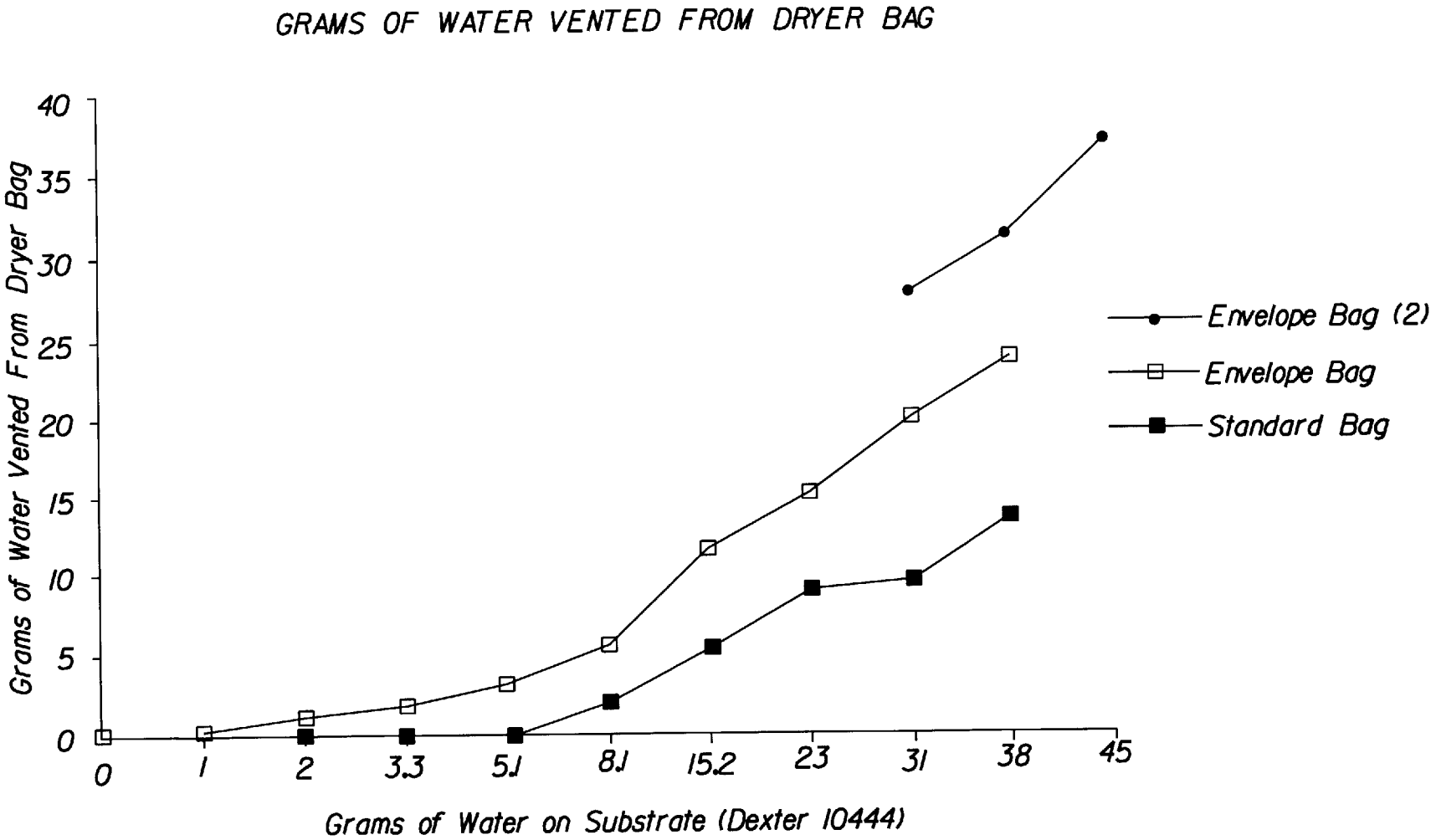
FIG. 9 is a graph of water venting as in FIG. 8, expressed in grams.

While the bags shown in the Figures are illustrated with VELCRO®-type fasteners, other fastening devices can be used. While the fastening devices herein can comprise chemical adhesives, the bag is preferably designed for multiple uses. Accordingly, reusable mechanical fasteners are preferred for use herein. Any reusable mechanical fastener or fastening means can be used, as long as the elements of the fastener can be arranged so that, when the bag is closed and the fastener is engaged, a vapor-venting closure is provided. Non-limiting examples include: bags wherein said first and second fastening devices, together, comprise a hook and loop (VELCRO®-type) fastener; bags wherein said first and second fastening devices, together, comprise a hook and string type fastener; bags wherein said first and second fastener devices, together, comprise an adhesive fastener; bags wherein said first and second fastening devices, together, comprise a toggle-type fastener; bags wherein said first and second fastwing devices, together, form a snap-type fastener; as well as hook and eye fasteners, ZIP LOK®-style fasteners, zipper-type fasteners, and the like, so long as the fasteners are situated so that vapor venting is achieved. Other fasteners can be employed, so long as the vapor-venting is maintained when the bag is closed, and the fastener is sufficiently robust that the flap does not open as the bag and its contents are being tumbled in the clothes dryer. The fastening devices can be situated that the multiple vapor-venting gaps are formed along the closure, or at the lateral edges, or so that the gap is offset to one end of the closure. In yet another embodiment, both ends of the bag are provided with a vapor venting closure. This type of bag is referred to in FIGS. 8, 9 and 10 as "Envelope Bag (2)".

In an alternate mode, the flap is folded to provide the closure and tucked inside the opposing side wall, and is secured there by a fastener. In this mode, vapors are vented along the closure and especially at the lateral edges of the closure. In yet another mode, the side walls are of the same size and no flap is provided. Fastening devices placed along a portion of the inner surfaces of the side walls are engaged when the lips of the side walls are pressed together to provide closure. One or more vapor-venting gaps are formed in those regions of the closure where no fastening device is present.

While the process herein can be conducted with any desired fabric treatment composition, the present invention preferably employs phase-stable, liquid fabric cleaning/refreshment compositions as described more fully hereinafter. The overall process herein provides a method for removing both localized and overall stains, soils and malodors from fabrics and otherwise refreshing fabrics by contacting said fabrics with such compositions.

In one aspect of the invention, the localized spot removal (a.k.a. "pre-spotting") step of the present invention is preferably conducted using a treatment means comprising a spot removal device, especially a device designed for hand-held use, comprising:

(a) a base member having a convex front treatment face and a rear face oppositely disposed from said treatment face;

(b) one or more treatment members extending outwardly from said treatment face; and (c) optionally, a hand grip affixed to said rear face.

A preferred device herein is wherein the front treatment face is substantially hemispherical, or alternatively, inscribes a section of a hemisphere. In one embodiment of the device, the face has a treatment member which comprises an absorbent material such as a sponge, a pad, or the like. In another embodiment, the treatment member comprises a multiplicity of protrusions, such as bristles. In yet another embodiment of the device, the treatment member comprises a sponge base having a multiplicity of protrusions extending outwardly therefrom. In other less preferred embodiments, the treatment means need not be part of the device as noted, but can be simple pads, sheets (e.g., disposable paper toweling), cloth wipes, sponges, or the like, which can be pressed against the stained area of the fabric.

The preferred pre-spotting procedure for removing stains from a stained area of fabrics, comprises the steps of:

(a) applying a cleaning composition (preferably, a cleaning/refreshment composition as described herein), to said stained area in contact with the ASRA;

(b) concurrently or consecutively with Step (a), contacting the stained area of the fabrics with treatment means, preferably using a convex device as noted above;

(c) applying compressive force to the device, especially using a rocking or rolling motion imparted to the device; wherein said procedure is conducted with the stained area of the fabric in contact with the stain receiver of this invention.

An overall dry cleaning process for treating an entire area of fabric surface, which comprises a prespotting operation according to this invention thus comprises the overall steps of:

(i) conducting a stain removal process according to the above disclosure on localized stained areas of fabric;

(ii) placing the entire fabric from step (i) together with a carrier containing the aqueous fabric refreshment/cleaning composition in the (preferably) vapor-venting containment bag;

(iii) placing the bag in a device to provide agitation, e.g., such as in a hot air clothes dryer and operating the dryer with heat and tumbling to moisten the fabric and provide vapor venting; and (iv) removing the fabric from the bag.

Following Steps (i) to (iv) it is preferred to promptly hang the slightly moist fabrics to avoid re-wrinkling and to complete the drying. Alternatively, the fabrics can be ironed.

Compositions—The chemical compositions which are used to provide the cleaning and refreshment functions comprise ingredients which are safe and effective for their intended use. Since the process herein does not involve an aqueous rinse step, the compositions employ ingredients which do not leave undesirable residues on fabrics when employed in the manner disclosed herein. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like.

In addition, the compositions herein comprise ingredients which are specially selected and formulated to minimize dye removal or migration from the stain site of fugitive, unfixed dye from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

The dye removal attributes of the present compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner/refresher using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) "I see a lot of dye on the towel"; through (4) "I know I see quite a lot of dye on the towel" are assigned by panelists.

In addition to the foregoing considerations, the compositions used herein are preferably formulated such that they are easily dispensed and not so adhesive in nature that they render the spot-cleaning device unhandy or difficult to use. However, and while not intending to be limiting of the present invention, the preferred compositions disclosed herein afford a spot-cleaning process which is both effective and aesthetically pleasing when used with a device according to this invention.

Surfactants—Nonionics such as the ethoxylated $C_{10}$–$C_{16}$ alcohols, e.g., NEODOL 23-6.5, can also be used in the compositions. The alkyl sulfate surfactants which may be used herein as cleaners and to stabilize aqueous cleaning compositions are the $C_8$–$C_{\sim}$primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$–$C_{16}$ alkyl, EO is —$CH_2CH_2$—O—, x is 1–10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$–$C_{16}$ dimethyl amine oxide surfactants can also be used. A preferred mixture comprises $MgAE_1S$/$MgAE_{6.5}S$/$C_{12}$ dimethyl amine oxide at a weight ratio of about 1:1:1. A more preferred mixture comprises $MgAE_1S$/$C_{12}$ dimethyl amine oxide at a weight ratio of about 10:1. Other surfactants which improve phase stability and which optionally can be used herein include the polyhydroxy fatty acid amides, e.g., $C_{12}$–$C_{14}$ N-methyl glucamide. AS stabilized compositions preferably comprise 0.1%–0.5%, by weight, of the compositions herein. MgAES and amine oxides, if used, can comprise 0.01%–2%, by weight, of the compositions. The other surfactants can be used at similar levels.

Having due regard to the foregoing considerations, the following illustrates the various other ingredients which can be used in the compositions herein, but is not intended to be limiting thereof.

Aqueous Compositions (a) Solvent—The compositions herein may comprise from about 0% to about 6%, by weight, of BPP solvent.

(b) Water—The compositions herein may comprise from about 94%, preferably from about 95.5% to about 99%, or even 99.9%, by weight, of water.

(c) Surfactant—The preferred compositions herein may comprise from about 0.05% to about 2%, by weight, of surfactants such as ethoxylated alcohols or alkyl phenols, alkyl sulfates or MgAES, $NH_4AES$, amine oxides, and mixtures thereof. Typically, the weight ratio of BPP solvent:surfactant(s) is in the range of from about 10:1 to about 1:1. A preferred composition comprises 2% BPP/0.3% $MgAE_1S$/0.03% $C_{12}$ dimethyl amine oxide.

(d) Optionals—The compositions herein may comprise minor amounts of various optional ingredients, including perfumes, preservatives, and the like. If used, such optional ingredients will typically comprise from about 0.05% to about 2%, by weight, of the compositions, having due regard for residues on the cleaned fabrics.

Organic Solvent—The preferred cleaning solvent herein is butoxy propoxy propanol (BPP) which is available in commercial quantities as a mixture of isomers in about equal amounts. The isomers, and mixtures thereof, are useful herein. The isomer structures are as follows:

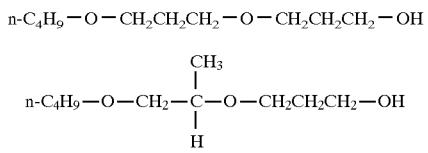

-continued

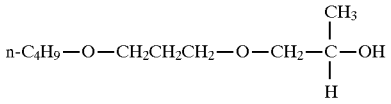

While the liquid cleaning compositions herein function quite well with only the BPP, water and stabilizing surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein. Non-aqueous (less than 50% water) compositions which optionally can be used in the pre-spotting step can comprise the same organic solvents.

Other Optionals—In addition to the water, the preferred BPP solvent and the surfactants disclosed above, the compositions herein may comprise various optional ingredients, such as perfumes, preservatives, brighteners, salts for viscosity control, pH adjusters or buffers, and the like. The following illustrates preferred ranges for cleaning compositions for use herein, but is not intended to be limiting thereof

| Ingredient | % (wt.) Formula Range |
|---|---|
| BPP | 0.05–5 |
| AS | 0.05–2 |
| Perfume | 0.01–1.5 |
| Water | Balance |
| pH range from about 6 to about 8. | |

Other cleaning solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and BPP, as well as butoxy propanol (BP), and the like, and mixtures thereof. If used, such solvents or co-solvents will typically comprise from about 0.5% to about 2.5%, by weight, of the compositions herein.

Preferred refreshment compositions herein are as follows.

| Ingredient | % (wt.) | Range (% wt.) |
|---|---|---|
| Water | 99.0 | 95.1–99.9 |
| Perfume | 0.5 | 0.05–1.5 |
| Surfactant* | 0.5 | 0.05–2.0 |
| Ethanol or Isopropanol | 0 | Optional to 4% |

*Especially ethoxylated alcohols, as disclosed herein. The fabric refreshment compositions may also contain anionic surfactants. Such anionic surfactants are well-known in the detergency arts. Commercial surfactants available as TWEEN ®, SPAN ®, AEROSOL TO ® and other various sulfosuccinic esters are especially useful herein.

Carrier—When used in the "in-dryer" cleaning/refreshment operation of the present type, the foregoing cleaning and/or refreshment compositions are conveniently used in combination with a carrier, such that the compositions perform their function as the surfaces of the fabrics come in contact with the surface of the carrier. The carrier releasably contains the compositions. By "releasably contains" means that the compositions are effectively released from the carrier onto the soiled fabrics as part of the spot removal, dry cleaning and/or fabric refreshment processes herein.

The carrier can be in any desired form, such as powders, flakes, shreds, and the like. However, it will be appreciated that such comminuted carriers would have to be separated from the fabrics at the end of the process. Accordingly, it is highly preferred that the carrier be in the form of an integral pad or sheet which substantially maintains its structural integrity throughout the process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning or refreshment composition or with the fabrics being cleaned. In general, non-woven polyester-based pads or sheets are quite suitable for use as the carrier herein.

The carrier used herein is most preferably non-linting. By "non-linting" herein is meant a carrier which resists the shedding of visible fibers or microfibers onto the fabrics being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-linting qualities of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, sheds lint. The core is then enveloped within a sheet of porous, non-linting material having a pore size which allows passage of the cleaning or refreshment compositions, but through which lint from the core cannot pass. An example of such a carrier comprises a cellulose or polyester fiber core enveloped in a non-woven polyester scrim.

The carrier should be of a size which provides sufficient surface area that effective contact between the surface of the carrier and the surface of the fabrics being treated is achieved. Of course, the size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a rectangular carrier may have the dimensions (X-direction) of from about 20 cm to about 35 cm, and (Y-direction) of from about 18 cm to about 45 cm. Two or more smaller carrier units can be used when a larger surface area is desired (or needed).

The carrier is intended to contain a sufficient amount of the cleaning or refreshment compositions to be effective for their intended purpose. The capacity of the carrier for such compositions will vary according to the intended usage. For example, pads or sheets which are intended for a single use will require less capacity than such pads or sheets which are intended for multiple uses. For a given type of carrier the capacity for the cleaning or refreshment composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning or refreshment composition is effectively provided by means of the carrier.

A preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference.

Preferred materials for use herein have the following physical properties.

| | Grade 10244 | Targets | Optional Range | |
|---|---|---|---|---|
| Basis Weight | $gm/m^2$ | 55 | 35–75 | |
| Thickness | microns | 355 | 100–1500 | |
| Density | gm/cc | 0.155 | 0.1–0.25 | |
| Dry Tensile | gm/25 mm | | | |
| MD | | 1700 | 400–2500 | |
| CD | | 650 | 100–500 | |
| Wet Tensile | gm/25 mm | | | |
| MD* | | 700 | 200–1250 | |
| CD* | | 300 | 100–500 | |
| Brightness | % | 80 | 60–90 | |
| Absorption Capacity | % | 735 | 400–900 | ($H_2O$) |
| Dry Mullen | $gm/cm^2$ | 1050 | 700–1200 | |

*MD - machine direction; CD - cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning and/or refreshment compositions herein, but actually optimizes cleaning performance. While not intending to be limited by theory, it may be speculated that this carrier is more effective in delivering the compositions to soiled fabrics. Or, this particular carrier might be better for removing soils by contact with the soiled fabrics, due to its mixture of fibers. Whatever the reason, improved dry cleaning performance is secured.

In addition to the improved performance, it has now been discovered that this hydroentangled carrier material provides an additional, unexpected benefit due to its resiliency. In-use, the sheets herein are designed to function in a substantially open configuration. However, the sheets may be packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used, if desired). Accordingly, this attribute of the hydroentangled carrier materials herein makes them optimal for use in the manner of the present invention.

Controlled Release Carriers—Other carriers which can be used in the present invention are characterized by their ability to absorb liquid cleaning compositions, and to release them in a controlled manner. Such carriers can be single-layered or multi-layer laminates. In one embodiment, such controlled-release carriers can comprise the absorbent core materials disclosed in U.S. Pat. No. 5,009,653, issued Apr. 23, 1991, to T. W. Osborn III, entitled "Thin, Flexible Sanitary Napkin", assigned to The Procter & Gamble Company, incorporated herein by reference. Another specific example of a controlled-release carrier herein comprises a hydroentangled web of fibers (as disclosed above) having particles of polymeric gelling materials dispersed, either uniformly or non-uniformly, in the web. Suitable gelling materials include those disclosed in detail at columns 5 and 6 of Osborn, as well as those disclosed in U.S. Pat. No. 4,654,039, issued Mar. 31, 1987, to Brandt, Goldman and Inglin. Other carriers useful herein include WATER-LOCK® L-535, available from the Grain Processing Corporation of Muscatin, Iowa. Non-particulate superabsorbents such as the acrylate fibrous material available under the tradename LANSEAL F from the Choli Company of Higashi, Osaka Japan and the carboxymethylcellulose fibrous material available under the tradename AQUALON C from Hercules, Inc., of Wilmington, Del. can also be used herein. These fibrous superabsorbents are also convenient for use in a hydro-entangled-type web.

In another embodiment the controlled release carrier can comprise absorbent batts of cellulosic fibers or multiple layers of hydroentangled fibers, such as the HYDRASPUN sheets noted above. In this embodiment, usually 2 to about 5 sheets of HYDRASPUN, which can optionally be spot-bonded or spot-glued to provide a coherent multi-layered structure, provides an absorbent carrier for use herein without the need for absorbent gelling materials, although such gelling materials can be used, if desired. Other useful controlled release carriers include natural or synthetic sponges, especially open-cell polyurethane sponges and/or foams. Whatever controlled release carrier is selected, it should be one which imbibes the liquid cleaning compositions herein thoroughly, yet releases them with the application of pressure or heat. Typically, the controlled release carriers herein will feel wet or, preferably, somewhat damp-to-nearly dry to the touch, and will not be dripping wet when carrying 10–30 g. of the cleaning composition.

Coversheet—The coversheets which are optionally, but preferably, employed herein to enrobe the carrier sheet are distinguished from the carrier substrate sheets, inasmuch as the coversheets are relatively non-absorbent to the liquid cleaning/refreshment compositions as compared with the carrier sheets. The coversheets are constructed from hydrophobic fibers which tend not to absorb, "wick" or otherwise promote the transfer of fluids. While fluids can pass through the void spaces between the fibers of the coversheet, this occurs mainly when excessive pressure is applied to the article. Thus, under typical usage conditions the coversheet provides a physical barrier which keeps the absorbent carrier, which is damp from its load of aqueous cleaning/refreshment composition, from coming into direct contact with the fabrics being treated. Yet, the permeable coversheet does allow vapor transfer of the cleaning/refreshment composition from the carrier through the coversheet and into the containment bag, and thence onto the fabrics being treated.

One type of coversheet herein comprises a fibrous, permeable nonwoven or woven fabric. Such nonwoven or woven fibrous coversheets offer advantages over formed-film type coversheets known in the catamenials art. For example, formed-film coversheets (as described hereinafter) are often manufactured by hydroforming processes which are particularly suitable with polymer films such as polyethylene. While polyethylene can be used herein, there is some prospect that, due to its lower melting point, high dryer temperatures can cause its softening and/or melting in-use. This is particularly true if the article herein were to be released from the containment bag and fall into the hot dryer drum. While it is possible to prepare formed-film topsheets using nylon, polyester or other heat resistant polymeric sheets, such manufacture becomes somewhat more difficult and, hence, more expensive.

It has now also been determined that the coversheet herein should be of a thickness which effectively provides the physical barrier function. Even though made from hydrophobic fibers, if the coversheet is too thin, fluid passage can occur under the intended usage conditions. Accordingly, it has now been determined that the thickness of the fibrous coversheet should preferably be at least about 7 mils (0.18 mm), preferably from about 0.2 mm to about 0.6 mm. It has also been determined that the fibers used in the coversheet are preferably hydrophobic and preferably have a melting point above about 240° C.

Fibrous coversheets for use herein can readily be made from non-heat resistant fibers such as polyethylene. However, it has now been determined that preferred fibrous coversheets can be prepared using nylon (especially nylon-6), polyester, and the like, heat-resistant fibers which can withstand even inadvertent misuse in the present process. The flexible, cloth-like, permeable topsheets made therefrom are conventional materials in the art of nonwoven and woven fabric making, and their manufacture forms no part of the instant invention. Nonwoven fabrics for use as coversheets are available commercially from companies such as Reemay, Inc., Hickory, Tenn. Such coversheets also pick up solid dust particles, vagrant lint and other fibers from the fabrics being treated in the present process, thereby enhancing the overall clean/refreshed appearance of the fabrics following the treatment herein.

Such nonwoven or woven fibrous sheet materials can be used in a flat single layer or as multiple layers as the coversheet for the absorbent carrier core herein. In another embodiment, the absorbent core carrying the cleaning/refreshment composition is enrobed in a polyester or polyamide fibrous coversheet which has been ring rolled or otherwise crimped to provide three dimensional bulk. Optionally, this coversheet may be further covered by a second coversheet in an uncrimped configuration.

Such fibrous, preferably heat resistant and, most preferably, hydrophobic, coversheets thus provide various embodiments of the article herein. Suitable combinations can be employed, according to the desires of the manufacturer, without departing from the spirit and scope of the invention. If desired, the coversheet can be provided with macroscopic fenestrations through which the lint, fibers or particulate soils can pass, thereby further helping to entrap such foreign matter inside the article, itself.

A typical spun-bonded fibrous coversheet herein is commercially available from Reemay and has the following characteristics.

(a) Fabric Type—Non-woven, semi-dull, whitened homopolymer 100% virgin, spun-bonded polyester.

(b) Fiber Type—6.0 Denier straight, tri-lobal continuous fiber, copolymer polyester.

| Web Properties | Target | Range |
|---|---|---|
| a) Basis weight, roll average oz/yd$^2$ | 0.54 | 0.52 to 0.59 |
| b) Thickness | 8 mil | 7–8 mil |
| c) Fuzz level | | |

As measured by Reemay sled/drag method based on 0–5 scale. 5 being no fuzz level.

| | | | |
|---|---|---|---|
| Belt side | 2.5 | 5.0 | 1.8 |
| Jet side | 3.4 | 5.0 | 2.6 |

As noted above, another type of coversheet which can be used with the articles herein comprises the apertured "formed film" coversheets known in the art and from commercial use on catamenials. Apertured formed films are pervious to the liquid cleaning and/or refreshment compositions and vapors thereof, and yet non-absorbent. Thus, the surface of the formed film which is in contact with the fabrics remains relatively dry, thereby reducing water spotting and dye transfer. As with the fibrous coversheets, the apertured formed films capture and retain lint, fibrous matter such as pet hair, and the like, from the fabric being treated, thereby enhancing the cleaning/refreshment benefits afforded by the present articles. Suitable formed films are described in U.S. Pat. No. 3,929,135, entitled "Absorptive Structure Having Tapered Capillaries", issued to Thompson on Dec. 30, 1975; U.S. Pat. No. 4,324,246, entitled "Disposable Absorbent Article Having A Stain Resistant Coversheet", issued to Mullane and Smith on Apr. 13, 1982; U.S. Pat. No. 4,342,314, entitled "Resilient Plastic Web Exhibiting Fiber-Like Properties", issued to Radel and Thompson on Aug. 3, 1982; and U.S. Pat. No. 4,463,045, entitled "Macroscopically Expanded Three-Dimensional Plastic Web Exhibiting Non-Glossy Visible Surface and Cloth-Like Tactile Impression", issued to Ahr, Louis, Mullane and Ouellete on Jul. 31, 1984; U.S. Pat. No. 4,637,819 issued to Ouellette, Alcombright & Curro on Jan. 20, 1987; U.S. Pat. No. 4,609,518 issued to Curro, Baird, Gerth, Vernon & Linman on Sept. 2, 1986; U.S. Pat. No. 4,629,642 issued to Kernstock on Dec. 16, 1986; and EPO Pat. No. 0,165,807 of Osborn published Aug. 30, 1989; all of which are incorporated herein by reference. The apertures in such coversheets may be of uniform size or can vary in size, as disclosed in the foregoing published documents, which can be referred to for technical details, manufacturing methods, and the like. Such apertures may also vary in diameter in the manner of so-called "tapered capillaries". Such formed-film cover-sheets with tapered capillary apertures preferably are situated over the carrier sheet such that the smaller end of the capillary faces the carrier sheet and the larger end of the capillary faces outward. This helps prevent bulk liquid transfer, thereby minimizing water spotting on the fabrics being treated. In the main, apertures in the formed film coversheets used herein can have diameters in the range of from about 0.1 mm to about 1 mm, or as disclosed in the aforesaid patent references.

An article of the present type can be assembled as a laminate comprising a topmost fibrous sheet, an absorbent carrier sheet as the core and a bottommost fibrous sheet. The combination of topsheet and bottomsheet comprises the "coversheet" in the preferred embodiment of the articles herein. In one preferred mode, a bond extends around the periphery of the article. The purpose of this bond is to ensure that the absorbent carrier core maintains its original configuration relative to the coversheet when the article is being used in the manner of this invention. Stated simply, it has been discovered that if the absorbent sheet which comprises the core is not bonded to the "envelope" provided by the coversheet in-use, the carrier sheet tends to crumple and bunch-up inside the coversheet. This can interfere with the delivery of the cleaning/refreshment composition to the fabrics being treated.

Moreover, it has also been discovered that it is not preferred to tightly bond the coversheet to the carrier sheet across the entire face of the carrier sheet. Tightly bonding the coversheet closely to the carrier sheet can allow some liquid transfer to occur through the coversheet. Accordingly, the carrier sheet is bonded to the coversheet only in discrete areas. In one embodiment, this bonding is only around the periphery of the article. In another embodiment, spot-bonding at discrete areas across the face of the article can be employed. Various other bond patterns can be used. Preferably, the bonding is done at no more than about 50% of the area of the article, more preferably no more than about 10% of the area of the article, most preferably no more than about 1% of the area of the article.

Spot Removal Devices—The devices illustrated in the Figures which are optionally used in the pre-spotting operation of the overall process herein can be manufactured by injection molding using polymers such as low- and high-density polyethylene, polypropylene, nylon-6, nylon-6,6, acrylics, acetals, polystyrene, polyvinyl chloride, and the like. High density polyethylene and polypropylene are within this range and are preferred for use herein. Brightener-free materials are preferably used.

The treatment members on the devices herein can comprise natural or synthetic bristles, natural or synthetic sponges, absorbent pads such as cotton, rayon, regenerated cellulose, and the like, as well as the HYDRASPUN® fabric described hereinabove. Various useful materials are all well-known in the cleaning arts in conventional brushes and toothbrushes (see U.S. Pat. No. 4,637,660) and in various cleaning utensils. Sponges, pads, and the like will typically have a thickness of from about 1 mm to about 1.25 cm and can be glued to the convex front treatment face of the device. Preferably, the sponges, pads, bristled pads, etc., are typically co-extensive with substantially the entire treatment face.

The protuberances herein can be in the form of blunt or rounded bristles, which may be provided uniformly across the entire treatment face or in clusters. The protuberances can be in the form of monofilament loops, which can be circular, ovoid or elongated, or can be cut loops. The protuberances can comprise twisted fiber bundles, extruded nubs, molded finger-like appendages, animal hair, reticulated foams, rugosities molded into the face of the member, and the like. Protuberances made from monofilament fibers may be straight, twisted or kinked.

In one embodiment, the treatment member can comprise multiple components. In particular, the treatment member can comprise an absorbent base material which can be, for example, a natural or synthetic sponge, an absorbent cellulosic sheet or pad, or the like. In contact with and extending outward from this base material are multiple protrusions as disclosed above. A specific example of this embodiment is a treatment member comprising multiple looped protuberances made from monofilament fibers which protrude from a sponge base layer. In this embodiment, the absorbent base layer acts as a reservoir which feeds cleaning composition to the protuberances.

In various optional modes, the treatment members present on the convex face of the device herein can comprise a multi-layer composite comprising a sponge-like, resilient backing material for a fibrous layer having multiple fibrous elements extending outwardly therefrom. Such composites can be permanently or semipermanently affixed to the treatment members using glue or other conventional means, and, typically, are substantially co-extensive with the face of the treatment member. Such composites can be made from conventional materials, e.g., using a sponge, foam or other absorbent base pad material from about 0.5–20 mm thickness and a layer of fibers such as a conventional painter's pad with fibers having a length of from about 0.05 mm to about 20 mm.

The protuberances herein are typically provided as a bed or mat which comprises multiple strands or loops which extend therefrom in the Z-direction. Convenient and familiar sources include pile carpet-type materials, paint pad-type materials, and the like. In such embodiments, the treatment member will comprise several thousand protuberances per $cm^2$. With the preferred looped protuberances herein, there will typically be 10–500, preferably about 60–150, loops per $cm^2$. The choice of the source, style and number of protuberances are matters for the manufacturer's discretion, and the foregoing illustrations are not intended to be limiting of the invention.

The protuberances should preferably extend outwardly from the face of the treatment member for a distance of at least about 0.2 mm. While there is no upper limit to their length, there is essentially no functional reason for the protuberances to extend more than about 1.25 cm.

The protuberances can be made from plastic, rubber or any other convenient, resilient material which is stable in the presence of the cleaning composition. Fibrous protrusions can be made from natural or synthetic fibers. Fiber diameters can typically range from 0.1 mil (0.0025 mm) to 20 mil (0.5 mm). Again, this is a matter of selection and is not intended to be limiting.

In one embodiment, the protuberances are in the form of a multiplicity of stiffened, ovoid looped fibers which extend outwardly from the treatment face. Such looped fibers can comprise, for example, 7 mil (0.18 mm) monofilament loops of polypropylene extending at least about 0.03 inch (0.76 mm), typically from about 2.0 mm to about 1.5 cm, outwardly from the face of a backing material. The diameter of the loops at their widest point is about 1.3 mm. A convenient material for said looped protrusions is available commercially from APLIX Inc., Number 200, Unshaved Loop, Part No. DM32M000-QY. This material comprises a nylon backing with about 420 loops per square inch (65 loops per $cm^2$) extending from its surface.

It will be appreciated that the devices herein can be made from a variety of plastic, glass, wood, etc. materials and with various overall shapes, decorations and the like, according to the desires of the manufacturer. Of course, the devices are preferably made from materials which will not be affected by the various ingredients used in the cleaning compositions. The size of the devices is entirely optional. It is contemplated that rather large devices (e.g. 200–1000 $cm^2$ convex treatment face) would be suitable for mounting and use in a commercial cleaning establishment. For in-home use, the device is intended for hand-held use, and its dimensions are generally somewhat smaller; typically, the surface area of the convex treatment face for home use will be in the range of from about 10 $cm^2$ to about 200 $cm^2$. While the convex treatment faces illustrated herein are, mainly, sections of spheres, the convex face of the device can also be in the manner of a desk-style ink blotter. Stated otherwise, the front treatment face of the device can be outwardly curved over its operational plane, but flat along its sides.

While the surface area of the treatment members can be adjusted according to the desires of the manufacturer, it is convenient for a hand-held, home-use device to have a treatment face whose surface area is in the range from about 25 $cm^2$ to about 70 $cm^2$.

Figure 2:
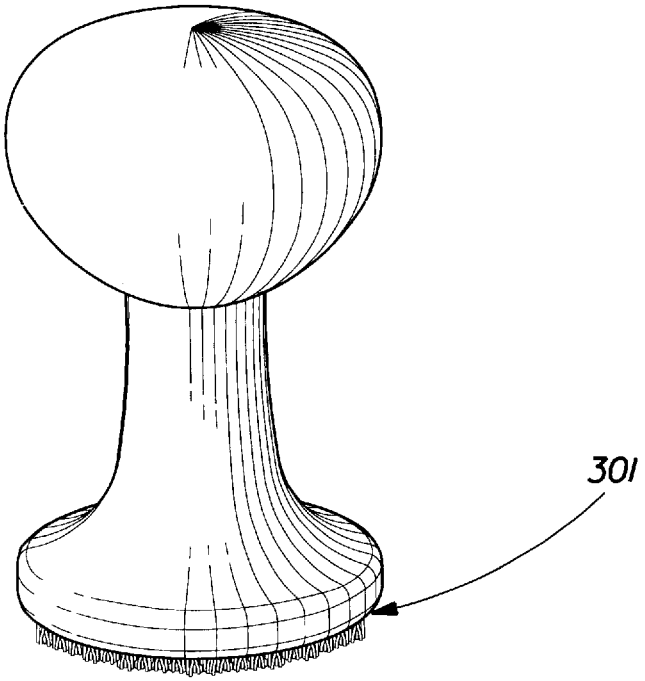
FIG. 2 is a perspective of a spot cleaning device of the type used herein having a convex base (301) whose circumference is substantially circular.

Device Dimensions—As an overall proposition, the cleaning device herein can be of any desired size. The device shown being used in FIG. 1 is of a size which is convenient for hand-held use. In this embodiment, the length of the arcuate base member with its convex, generally rectangular configuration is about 2.25 inches (57.15 mm); its width is about 1.25 inches (31.75 mm); and its thickness is about 0.625 inch (15.8 mm). The length of the cylindrical shaft extending perpendicularly outward from the rear of the arcuate base to the base of the hand-grip bulb is about 1.4 inches (35.6 mm), and its diameter is about 0.75 inches (19 mm). The bulb which is shown serving as a hand (or palm) rest at the terminal end of the shaft has a circumference at its widest point of about 5.25 inches (133 mm). The combination of shaft and bulb thus comprises the hand grip for the device. The overall height of the device measured from the center of the top of the bulb to the center point of the front face of the convex base is about 2⅞ inches (7.3 cm). The uncompressed thickness of the sponge layer which underlies the protuberances can vary, and is typically about 0.1 inches (2.54 mm). The uncompressed thickness of the layer of filamentous protrusions can likewise vary and is typically about 0.1 inches (2.54 mm). Similar dimensions are typical for the convex device of FIG. 2, whose circular base member has a diameter typically of about 0.75–3 inches (1.91–7.62 cm).

Figure 11:
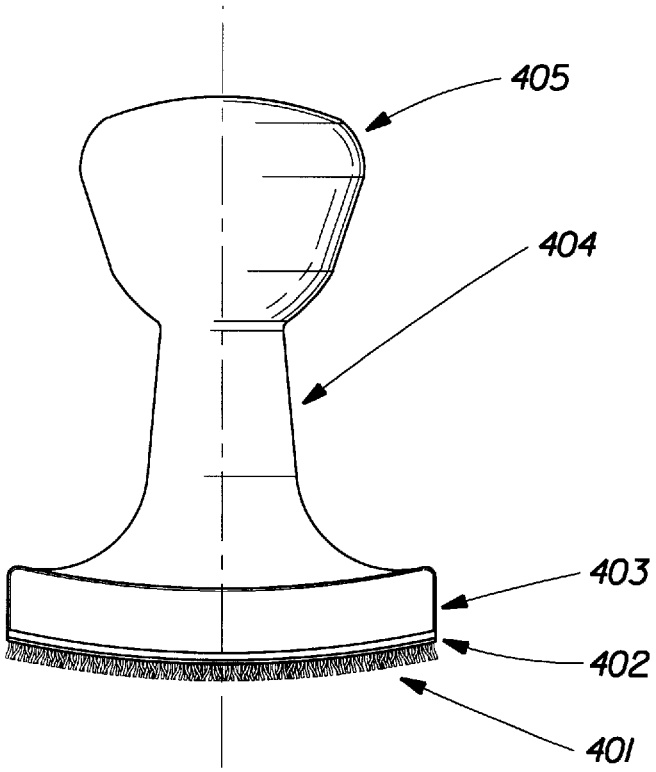
FIG. 11 is a perspective of a preferred arcuate cleaning device comprising cleaning protuberances (401), sponge layer (402), arcuate base (403), shaft (404) and bulbous hand grip (405).

In a preferred embodiment of the arcuate device shown in FIG. 11, the length of the arcuate base member (403) with its convex, generally rectangular configuration is about 2 inches (5 cm); its width is about 1.25 inches (3.2 cm); and its thickness is about 5/16 inch (0.8 cm). The width of shaft (404) at its mid-point is about 1 inch (2.54 cm) and its thickness at its midpoint is about 0.75 inch (1.9 cm). The length of the shaft (404) extending perpendicularly outward from the rear of the arcuate base to the base of bulb (405) is about 1.25 inches (3.2 cm). The bulb (405) which serves as a hand (or palm) rest has a circumference at its widest point of about 5.75 inches (14.6 cm). The combination of shaft and bulb thus comprise the hand grip for the device. The overall height of the device measured from the center of the top of the bulb (405) to the center point of the front face of the convex base is about 3 inches (7.6 cm). The dimensions of the sponge layer (402) and protuberances (401) are as given above.

The optional second stage of the overall process is conveniently conducted in a tumbling apparatus, preferably in the presence of heat. In one convenient mode a nylon or other heat-resistant containment bag with the carrier plus aqueous cleaning and/or refreshment composition and enveloping the pre-spotted fabric being cleaned and refreshed is closed and placed in the drum of an automatic hot air clothes dryer at temperatures of 40° C.–150° C. The drum is allowed to revolve, which imparts a tumbling action to the bag and agitation of its contents concurrently with the tumbling. By virtue of this agitation, the fabrics come in contact with the carrier containing the composition. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user.

The following examples illustrate the present invention in more detail, but are not intended to be limiting thereof.

EXAMPLE I

Examples of preferred, high water content compositions for use in the pre-spotting step herein are as follows. The compositions are listed as "nonionic" or "anionic", depending on the type of surfactant used therein. These compositions are used in the manner disclosed in Examples II, V or VI, hereinafter.

| Ingredient | Nonionic (%) | Anionic (%) |
|---|---|---|
| Butoxypropoxypropanol (BPP) | 2.00 | 2.00 |
| NEODOL 23 6.5 | 0.250 | — |
| $NH_4$Coconut $E_1S$* | — | 0.285 |
| Dodecyldimethylamine oxide | — | 0.031 |
| $MgCl_2$ | — | 0.018 |
| $MgSO_4$ | — | 0.019 |
| Hydrotrope, perfume, other minors | — | 0.101 |
| KATHON preservative | 0.0003 | 0.0003 |
| Water | 97.750 | 97.547 |

*Ammonium salt of $C_{12}$–$C_{14}$ (coconut alkyl) ethoxy EO-1) sulfate.

EXAMPLE II

A liquid fabric cleaning/refreshment product for use in a vented dryer bag is prepared, as follows.

| Ingredient | % (wt.) |
|---|---|
| Water | 99.3 |
| Emulsifier (TWEEN 20)* | 0.3 |
| Perfume | 0.4 |

*Polyoxyethylene (20) sorbitan monolaurate available from ICI Surfactants.

23 Grams of the product are applied to a 28 cm×38 cm carrier sheet of non-woven fabric, preferably HYDRASPUN®. In simple, yet effective, mode, the carrier sheet is placed in a pouch and saturated with the product. The capillary action of the substrate and, optionally, manipulation and/or laying the pouch on its side, causes the product to wick throughout the sheet. Preferably, the sheet is of a type, size and absorbency that is not "dripping" wet from the liquid. The pouch is sealed so that the liquid composition is stable to storage until use.

A multi-use liquid portion of the product is also prepared.

Step 1. A fabric to be cleaned and refreshed is selected. Localized stained areas of the fabric are situated over an absorbent TBAL stain receiver or other ASRA as disclosed herein and are treated by directly applying about 0.5–5 mls (depending on the size of the stain) of the liquid product of Example I, which is gently worked into the fabric using the device herein. The treated stains are padded with dry paper toweling. In an alternate mode, the refreshment product is releasably absorbed on a carrier sheet and applied to the stains.

Step 2. Following the pre-spotting step, the fabric is placed into a nylon bag (as disclosed above) together with the sheet (which is removed from its storage pouch and unfolded) releasably containing the cleaning/refreshment product of Example II. The mouth of the bag is closed to provide vapor-venting, and the bag and its contents are placed in the drum of a conventional hot air clothes dryer. The dryer is operated in standard fashion for 20–60 minutes at a high heat setting (an air temperature range of about 140°–170° F.; 60°–70° C.). After the tumbling action of the dryer ceases, the cleaned and refreshed fabric is removed from the bag. The used sheet is discarded.

EXAMPLE III

High water content ("Sweet Water") cleaning/refreshment compositions for use in the dryer step of the processes herein are as follows. The compositions are used in the manner disclosed hereinabove to clean and refresh fabrics.

| Components | Percent | Range (%) | Function |
|---|---|---|---|
| Water De-ionized | 98.8997 | 97–99.9 | Vapor Phase Cleaning |
| TWEEN 20 | 0.50 | 0.5–1.0 | Wetting Agent, Emulsifier for Perfume |
| Perfume | 0.50 | 0.1–1.50 | Scent, Aesthetics |
| KATHON CG* | 0.0003 | 0.0001–0.0030 | Anti-bacterial |
| Sodium Benzoate* | 0.10 | 0.05–1.0 | Anti-fungal |

*Optional preservative ingredients.

20–30 Grams, preferably about 23 grams, of the Sweet Water composition is absorbed into a 28 cm×38 cm HYDRASPUN® carrier sheet (the sheet is preferably not "dripping" wet) which is of a size which provides sufficient surface area that effective contact between the surface of the carrier sheet and the surface of the fabrics being cleaned and refreshed is achieved. The sheet is used in the foregoing manner to clean and refresh fabrics in a hot air clothes dryer.

EXAMPLE IV

A liquid pre-spotting composition is formulated by admixing the following ingredients.

| Ingredient | % (wt.) |
|---|---|
| BPP | 4.0 |
| $C_{12}$–$C_{14}$ AS, Na salt | 0.25 |
| Water and minors* | Balance |

*Includes preservatives such as KATHON ® at levels of 0.00001%–1%, by weight.

The fabric to be treated is laid flat on an absorbent TBAL stain receiver sheet or any of the other ASRA's disclosed herein, and 0.5 ml–4 ml of the composition is applied directly to the stain and worked in using the cleaning device.

Other useful compositions which can be used in this step are as follows:

| Ingredient | Percent (wt.) | (Range. wt.) |
|---|---|---|
| BPP | 4.0 | 0.1–4.0% |
| $C_{12}$–$C_{14}$ AS | 0.4 | 0.1–0.5% |
| Nonionic Surfactant (optional)* | 0.1 | 0–0.5% |
| Water (distilled or deionized) | Balance | 95–99.8% |
| Target pH = 7.0 | | |

-continued

| Ingredient | Percent (wt.) | (Range. wt.) |
|---|---|---|

*The optional nonionic surfactants in the compositions herein are preferably $C_{12}$–$C_{14}$ N-methyl glucamides or ethoxylated $C_{12}$–$C_{16}$ alcohols (EO 1–10).

The foregoing illustrates pre-spotting compositions using the AS surfactant. Improved cleaning performance can be achieved using MgAES and amine oxide surfactants, although possibly with some reduction in phase stability. Thus, aqueous compositions with ca. 2–3% BPP can be stabilized using MgAES surfactants. However, for compositions containing 4%, and higher, BPP, the formulator may wish to include AS surfactant. The amount and blend of surfactants will depend on the degree of temperature-dependent phase stability desired by the formulator. Amine oxide surfactants such as dimethyl dodecyl amine oxide can also be used in the compositions.

The pre-spotted fabric is then placed in a flexible venting "Envelope"-style bag together with a sheet releasably containing about 20–25 grams of a cleaning/refreshment composition according to any of the Examples herein. The bag is closed using a VELCRO®-type fastener. The closure provides a vapor-venting gap along the mouth of the bag, but is sufficiently robust to retain the fabric in the bag during the treatment. In a typical mode, the bag will have a volume of about 25,000 $cm^3$, which will accommodate up to about 2 kg of dry fabrics. When the fabrics and the sheet are placed in the bag, the air is preferably not squeezed out of the bag before closing. The closed bag is placed in a conventional hot-air clothes dryer. The dryer is started and the bag is tumbled for a period of 20–30 minutes at a dryer air temperature in the range from about 40° C. to about 150° C. During this time, the sheet comes into close contact with the fabrics. The water vapors and malodorous, volatile materials are vented from the bag through the gap at the mouth of the bag. After the machine cycle is complete, the bag and its contents are removed from the dryer, and the spent sheet is discarded. The bag is retained for re-use. The fabrics are cleaned and refreshed. Excellent overall cleaning and refreshment are secured when from about 3 g to about 50 g of the preferred compositions herein are used per kilogram of fabric being treated.

With respect to the wrinkle-removing function of the in-dryer step of the process and the compositions herein, it will be appreciated that wrinkling can be affected by the type of fabric, the fabric weave, fabric finishes, and the like. For fabrics which tend to wrinkle, it is preferred not to overload the containment bag used herein. Thus, for a bag with, for example, an operational capacity of up to about 5 kg of fabrics, it may be best to process up to only about 60% of capacity, (i.e., up to about 3 kg of fabrics) to further minimize wrinkling.

EXAMPLE V

A low residue liquid fabric cleaning/refreshment product for use preferably in a vented dryer bag is prepared, as follows.

| Ingredient | % (wt.) |
|---|---|
| Emulsifier (TWEEN 20)* | 0.5 |
| Perfume | 0.5 |
| KATHON ®** | 0.0003 |

-continued

| Ingredient | % (wt.) |
|---|---|
| Sodium Benzoate | 0.1 |
| Water | Balance |

*Polyoxyethylene (20) sorbitan monolaurate available from ICI Surfactants.
**Preservative A 10¼ in.×14¼ in. (26 cm×36 cm) carrier sheet of HYDRASPUN® is prepared. The carrier sheet is covered on both sides with a topsheet and a bottomsheet of 8 mil (0.2 mm) Reemay fabric coversheet material of the type described hereinabove. The coversheet (i.e., both topsheet and bottomsheet) are bonded to the carrier sheet by a Vertrod® or other standard heat sealer device, thereby bonding the laminate structure together around the entire periphery of the carrier sheet. The edges of the carrier sheet around its periphery are intercalated between the topsheet and bottomsheet by the bond. The width of the bond is kept to a minimum and is about 0.25 in. (6.4 mm).

The bonded laminate structure thus prepared is rolled somewhat loosely around a cylindrical void into a generally tubular shape of about 26 cm length and a diameter of about 2–3 cm. The rolled article is then folded to half its length at about its mid-point by means of a thrusting blade which also serves to insert the article into a retaining pouch. It is observed that, with the rolling method herein, essentially no severely sharp creases are formed, and the final doubling of the rolled tube is under such stress that only in the very center of the bend are a few sharper creases formed. The result is that permanent refolding along crease lines is essentially avoided, and release of the cleaning/refreshment composition from the article in-use is optimized.

Any plastic or flexible pouch which does not leak is suitable for use herein. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis. As a point of comparison, the pouch containing the rolled/folded article herein has overall dimensions of about 8.5 cm×17.7 cm, whereas a pouch for a similar planar-folded article is about 13 cm×17.7 cm. A savings in material of about 30–40% is thus achieved.

23 Grams of the liquid product are poured onto the article within the pouch and allowed to absorb into it for a minimum of 30 minutes, preferably for at least about 4 hours. The pouch is sealed immediately after the liquid product is introduced into the pouch and stored until time-of-use.

As an entirely optional matter, the carrier sheet can also have holes punched therethrough in order to further maximize its ability to maintain an open configuration in-use. Indeed, the holes can be punched through the entire article, including the coversheet itself. For an article having the overall dimensions of about 27 cm×37 cm, 16 round holes, each about 0.5 in. (1.27 cm) in diameter are evenly spaced across the HYDRASPUN carrier sheet. Slits or other perforations may be used in like manner.

After spot-cleaning using a TBAL, LBAL, MBAL or foam ASRA in the manner of this invention, the fabric being treated is placed into a 26 in.×30 in. (66×76 cm) vapor-venting nylon bag as shown in the Figures together with the sheet (which is removed from its storage pouch, unfolded and unrolled) releasably containing the aforesaid cleaning/refreshment product. The mouth of the bag is closed to provide vapor-venting, and the bag and its contents are placed in the drum of a conventional hot air clothes dryer. The dryer is operated in standard fashion for 20–60 minutes at a high heat setting (an air temperature range of about 140°–170° F.; 60°–70° C.). After the tumbling action of the dryer ceases, the cleaned and refreshed fabric is removed from the bag. The used sheet is discarded. The fabric (which is preferably still slightly damp) is preferably hung on a conventional hanger to complete the drying process thereby further avoiding wrinkles.

If a foam, or partially foam, ASRA is to be used herein, the foam can be absorbent polyurethane or FAM ("HIPE"—high internal phase emulsion) foams known in the art; see, for example, U.S. Pat. Nos. 5,260,345 and 5,550,167. FAM foams tend to be friable under mechanical stress and should preferably be enrobed in a liquid permeable fabric or mesh as a reinforcing means. Reinforcing fabrics include low basis weight (ca. 18 gsm) spunbonded polyester (Reemay) or carded polypropylene sheets, such as those used commercially as diaper topsheets. Other materials include women's nylon hose fabric.

EXAMPLE VI

A pre-spotting operation herein for removing stain from a localized area on a fabric is conducted by:

(a) underlaying the area containing said stain with an ASRA according to this invention, e.g., a TBAL absorbent stain receiver;

(b) applying 0.1–25 mls of a liquid cleaner (pre-spotter) composition of Example I to said stain from a container having a dispenser spout; and (c) rubbing or pressing said cleaning composition into said stain using the distal tip of said spout, whereby said stain is transferred into the stain receiver.

In this mode, the face of the distal tip of said spout can be concave, convex, flat, or the like. The combination of container plus spout is referred to herein conjointly as the "dispenser".

A typical dispenser herein has the following dimensions, which are not to be considered limiting thereof. The volume of the container bottle used on the dispenser is typically 2 oz.–4 oz. (fluid ounces; 59 mls to 118 mls). The larger size container bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal of 0.182 inches (4.6 mm). The diameter of the channel within the spout through which the pre-spotting fluid flows is approximately 0.062 inches (1.57 mm). In this embodiment, the channel runs from the container bottle for a distance of about 0.474 inches (1.2 cm) and then expands slightly as it communicates with the concavity to form the exit orifice at the distal end of the spout.

In a highly preferred mode, the liquid Nonionic or Anionic composition of Example I is applied to the stained area from the dispenser and rubbed into the stain using the dispenser tip. In this mode, a sheet of organza fabric is preferably laid over and in direct contact with the stained area such that the dispenser spout rubs on the organza rather than directly on the fabric being treated. This minimizes abrasion damage on the fabric being treated. The organza is a commercially-available polyester material: basis weight 26.33 grams/meter$^2$; caliper at 0.1 psi 1.02 mm; caliper at 2 psi 0.76 mm; opacity % 54.1; 24 vertical×25 horizontal threads per quarter inch.

While the process and components thereof have been described herein both broadly and in detail, modifications thereof which meet the foregoing considerations fall within the spirit and scope of the present invention. Kits according to the present invention conveniently contain 1 to about 10 of the in-dryer sheets, from about 1 to about 6 of the sheet-form ASRA's and bottled portions (typically about 10 ml to about 100 ml) of the pre-spotting composition. However, larger or smaller quantities of the sheets, receivers and/or the pre-spotter can be provided. Kits comprising one or more ASRA's and a portion, e.g., 5–200 mls, of cleaning composition are also provided herein.

As can be seen from the disclosure herein, the present invention thus provides: in a process for removing localized spots or stains from a fabric by means of a cleaning device as described herein used in conjunction with a liquid cleaning composition, by placing the stained or spotted area of the fabric over and in contact with a liquid absorbing article, applying the cleaning composition (preferably liquid, or gel, or paste) to the stain or spot, and applying Z-directional force thereto by means of said cleaning device, the improvement wherein said liquid absorbing article comprises an ASRA, especially a bi-layer fibrous TBAL structure, as described herein, whereby the stain/spot material is efficiently and effectively absorbed onto and into said ASRA while minimizing the tendency of the stain or spot to spread laterally on the fabric when mobilized by the cleaning composition. The formation of "rings" on the fabric is thereby minimized.

What is claimed is:

1. A process for spot cleaning stained fabrics comprising the steps of:

(a) placing a localized stained area of the fabric over and in contact with an Absorbent Stain Receiver Article, which is a fibrous TBAL structure;

(b) applying enough cleaning/refreshment composition to the fabric to saturate the localized stained area;

(c) optionally, allowing the composition to penetrate the stain for 3–5 minutes;

(d) removing the fabric from contact with the Absorbent Stain Receiver Article; and wherein the composition is worked into the stain by means of mechanical force applied to the stain.

2. A process according to claim 1 wherein said composition comprises water and a surfactant.

3. A composition according to claim 2 wherein the surfactant comprises a mixture of magnesium alkyl ethyoxy sulfate surfactant and amine oxide surfactant.

4. A process according to claim 1 wherein said composition comprises water and a solvent.

5. A process according to claim 4 wherein the solvent is butoxy propoxy propanol.

6. A process according to claim 5 wherein said composition comprises the solvent and at least about 95%, by weight, of water.

7. A process according to claim 1 wherein said composition comprises a solvent and a surfactant.

8. A process according to claim 1 wherein said composition comprises water, a solvent and a surfactant.

9. A process according to claim 1 wherein the synthetic fiber content of a low capillary pressure zone of the Absorbent Stain Receiving Article is higher than the synthetic fiber content of a high capillary pressure zone.

10. A process according to claim 9 wherein the Absorbent Stain Receiving Article comprises a fibrous TBAL structure wherein the fiber content of the low capillary pressure zone is about 100%, by weight, of synthetic fiber.

11. In a process for removing localized spots or stains from a fabric by means of a cleaning device used in conjunction with a liquid cleaning composition, by placing the stained or spotted area of the fabric over and in contact with a liquid absorbing article, applying the cleaning composition to the stain or spot, and applying Z-directional force thereto by means of said cleaning device, the improvement wherein said liquid absorbing article comprises a bi-layer TBAL structure, whereby the stain/spot material is efficiently and effectively absorbed onto and into said bi-layer structure while minimizing the tendency of the stain or spot to spread laterally on the fabric when mobilized by the cleaning composition.

12. An overall cleaning/refreshment process for treating an entire area of fabric comprising the overall steps of:

(i) conducting a stain removal process according to claim 1;

(ii) placing the entire fabric from step (i) together with a carrier containing an aqueous fabric cleaning/refreshment composition in a containment bag; and;

(iii) placing the bag in a device to provide heat and agitation.

* * * * *